US008413979B2

(12) United States Patent
Sato

(10) Patent No.: US 8,413,979 B2
(45) Date of Patent: Apr. 9, 2013

(54) RECORDING MEDIUM POST-PROCESSING APPARATUS AND IMAGE FORMING SYSTEM

(75) Inventor: Ryuichi Sato, Kanagawa (JP)

(73) Assignee: Fuji Xerox Co., ltd., Tokyo (JP)

( * ) Notice: Subject to any disclaimer, the term of this patent is extended or adjusted under 35 U.S.C. 154(b) by 0 days.

(21) Appl. No.: 13/041,603

(22) Filed: Mar. 7, 2011

(65) Prior Publication Data

US 2012/0034009 A1 Feb. 9, 2012

(30) Foreign Application Priority Data

Aug. 3, 2010 (JP) ..... 2010-174704

(51) Int. Cl.
*B65H 37/04* (2006.01)

(52) U.S. Cl.
USPC ..... 270/58.08; 270/58.07

(58) Field of Classification Search ..... 270/37, 270/52.18, 58.07, 58.08; 399/408, 410
See application file for complete search history.

(56) References Cited

U.S. PATENT DOCUMENTS

2009/0179373 A1* 7/2009 Awano et al. ..... 270/58.08

FOREIGN PATENT DOCUMENTS

JP 2004-277036 A 10/2004
JP 2008-110468 A 5/2008

* cited by examiner

*Primary Examiner* — Leslie A Nicholson, III
(74) *Attorney, Agent, or Firm* — Sughrue Mion, PLLC

(57) ABSTRACT

A recording medium post-processing apparatus includes a recording medium stacking member; a first binding member that moves to an inside of a stacked area, binds the recording media by deforming the recording media, and moves to an outside of the stacked area after binding the recording media; and a guiding member disposed between the first binding member and the recording media and fixed to the first binding member, the guiding member guiding the recording media so that a gap between the recording media and the first binding member is maintained when the first binding member moves around the inside of the stacked area, wherein the guiding member has an opening that surrounds an area in which the first binding member operates to deform the recording media, and a part of the opening is narrowed in a moving direction of the first binding member.

9 Claims, 17 Drawing Sheets

RECORDING MEDIUM POST-PROCESSING APPARATUS AND IMAGE FORMING SYSTEM

CROSS-REFERENCE TO RELATED APPLICATIONS

This application is based on and claims priority under 35 USC 119 from Japanese Patent Application No. 2010-174704 filed Aug. 3, 2010.

BACKGROUND (i) Technical Field

The present invention relates to a recording medium post-processing apparatus and an image forming system.

(ii) Related Art

There are image forming apparatuses, such as printers and copiers, which are connected to a recording medium post-processing apparatus for post-processing recording media on which images have been formed. In general, such a recording medium post-processing apparatus includes a binding mechanism for binding recording media and a punching mechanism for punching a hole at a predetermined position of the recording media.

SUMMARY

According to an aspect of the invention, a recording medium post-processing apparatus includes a recording medium stacking member onto which a plurality of recording media are stacked; a first binding member that moves to an inside of a stacked area in which the recording media are stacked on the recording medium stacking member, binds the recording media by deforming the recording media, and moves to an outside of the stacked area after binding the recording media; and a guiding member disposed between the first binding member and the recording media and fixed to the first binding member, the guiding member guiding the recording media so that a gap between the recording media and the first binding member is maintained when the first binding member moves around the inside of the stacked area, wherein the guiding member has an opening that surrounds an area in which the first binding member operates to deform the recording media, and a part of the opening is narrowed in a moving direction of the first binding member.

BRIEF DESCRIPTION OF THE DRAWINGS

Exemplary embodiment of the present invention will be described in detail based on the following figures, wherein.

DETAILED DESCRIPTION

Hereinafter, an exemplary embodiment of the present embodiment will be described with reference to the drawings.

Figure 1:
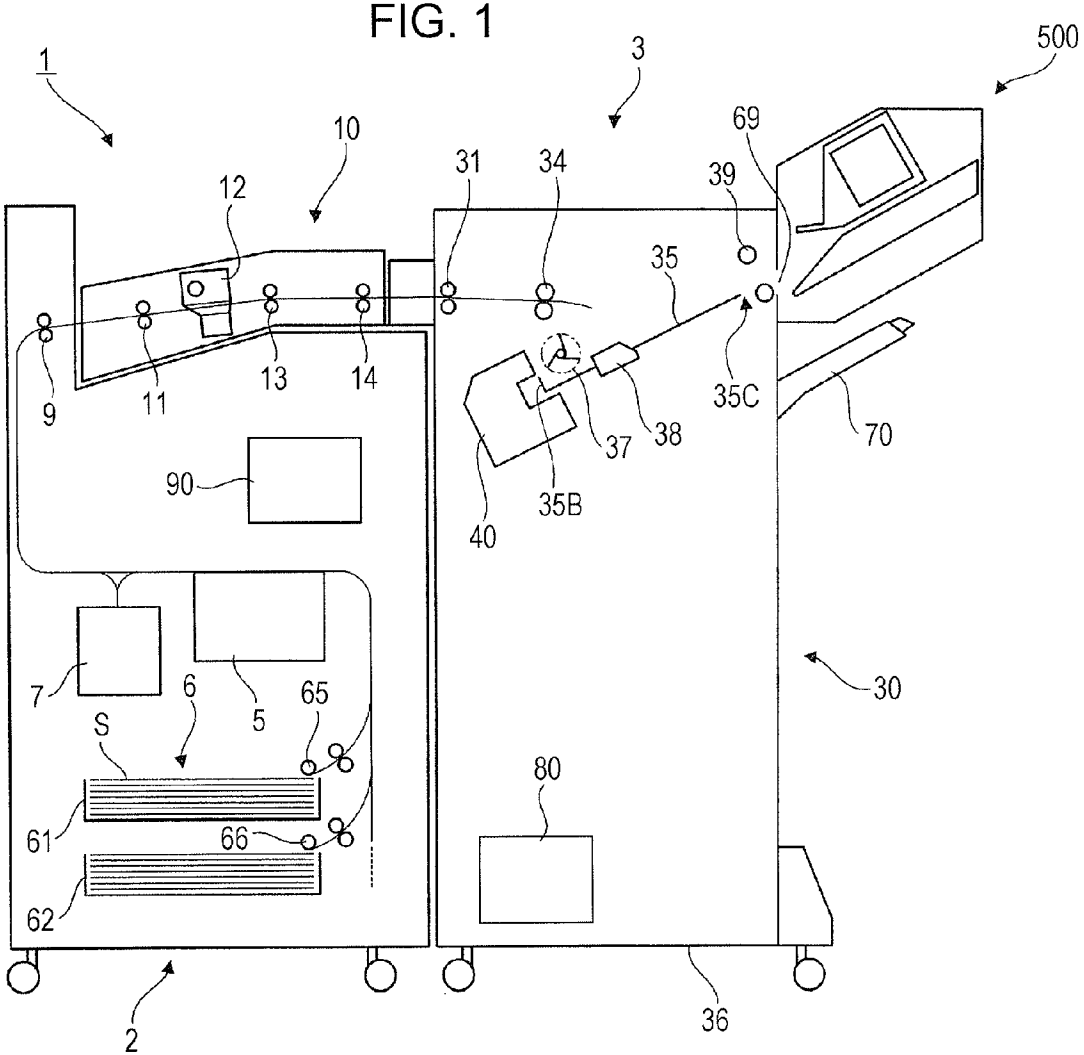
FIG. 1 is a schematic view of an image forming system according to the present exemplary embodiment.

FIG. 1 is a schematic view of an image forming system 1 according to the present exemplary embodiment. The image forming system 1 includes an image forming apparatus 2 and a sheet processing apparatus 3. The image forming apparatus 2, which is an example of an image forming apparatus such as a printer or a copier, forms an image by using, for example, an electrophotographic system. The sheet processing apparatus 3, which is an example of a recording medium post-processing apparatus, performs predetermined post-processing on a sheet (recording medium) S on which, for example, a toner image has been formed by the image forming apparatus 2.

The image forming apparatus 2 includes a sheet supplier 6, which supplies the sheet S, and an image forming unit 5. The image forming unit 5 forms an image on the sheet S, which is supplied from the sheet supplier 6, by using an electrophotographic system. The image forming unit 5 may form an image by using another method, such an inkjet method. The image forming apparatus 2 includes a sheet reversing unit 7 and output rollers 9. The sheet reversing unit 7 reverses the sheet S on which an image has been formed by the image forming unit 5. The output rollers 9 output the sheet S on which an image has been formed. The image forming apparatus 2 further includes a user interface 90 that receives information from a user. The sheet supplier 6 includes a first sheet tray 61 and a second sheet tray 62, on which the sheets S are stacked. The sheet supplier 6 further includes a supply roller 65 and a supply roller 66. The supply roller 65 transports the sheets S that are stacked on the first sheet tray 61 toward the image forming unit 5. The supply roller 66 transports the sheets S that are stacked on the second sheet tray 62 toward the image forming unit 5.

The sheet processing apparatus 3 includes a transport device 10 and a body 30. The transport device 10 transports a sheet S that has been output from the image forming apparatus 2. The body 30 includes a sheet stacker 35, on which the sheets S that have been transported by the transport device 10 are stacked, and a stapler 40 that binds an end portion or the sheets S. The sheet processing apparatus 3 further includes a controller 80 that controls the entirety of the image forming system 1. The controller 80 includes a central processing unit (CPU), a read only memory (ROM), a random access memory (RAM), and a hard disk drive (HDD) (which are not shown). The CPU executes a control program for controlling the image forming system 1. The ROM stores various programs, tables, and parameters. The RAM is used, for example, as a work area when the CPU executes the control program.

The transport device 10 of the sheet processing apparatus 3 includes a pair of inlet rollers 11 and a puncher 12. The inlet rollers 11 receive the sheet S that has been output through the output rollers 9 of the image forming apparatus 2. The puncher 12 punches a hole, as necessary, in the sheet S that has been received by the inlet rollers 11. The transport device 10 includes a pair of first transport rollers 13 and a pair of second transport rollers 14. The first transport rollers 13 transport the sheet S downstream from the puncher 12. The second transport rollers 14 transport the sheet S toward the body 30.

The body 30 of the sheet processing apparatus 3 has a box-shaped body frame 36. The body 30 includes a pair of receiving rollers 31 that receive the sheet S from the transport device 10. The body 30 includes the sheet stacker 35 and a pair of exit rollers 34. The sheet stacker 35, on which the sheets S are stacked, is disposed downstream of the receiving rollers 31. The exit rollers 34 output the sheets S toward the sheet stacker 35. The body 30 includes a paddle 37. The paddle 37 rotates clockwise in FIG. 1 and transports the sheet S, which has been transported by the exit rollers 34, toward an end guide 35B of the sheet stacker 35. The body 30 includes tampers 38, one of which facing one side edge of the sheet S and the other of which facing the other side edge of the sheet S. The tampers 38 press the sheet S from both sides so as to align the sheet S.

The body 30 includes an eject roller 39. The eject roller 39 is movable in a direction in which the eject roller 39 becomes close to the sheet stacker 35 and in a direction in which the eject roller 39 becomes away from the sheet stacker 35. When the sheets S are being stacked on the sheet stacker 35, the eject roller 39 is retracted to a position away from the sheet stacker 35 (vertically above the sheet stacker 35). When a stack of the sheets S (hereinafter refereed to as a "sheet stack T") is to be ejected from the sheet stacker 35, the eject roller 39 moves to a position at which the eject roller 39 contacts the sheet stack T and rotates so as to transport the sheet stack T downstream.

The body 30 includes the stapler 40. The stapler 40 binds an end portion of the sheet stack T that is placed on the sheet stacker 35 (a trailing end portion the sheet stack T with respect to the transport direction) using a staple.

An opening 69 is formed in a side wall of the body frame 36 of the body 30. The sheet stack T, which has been transported by the eject roller 39, is ejected through the opening 69.

The body 30 includes a binding device 500, which is an example of a binding unit. The binding device 500 performs a binding process on the leading end of the sheet stack T (in the transport direction of the sheet stack T), which has been transported by the eject roller 39. The binding device 500 is different from the above-described stapler 40 in that the binding device 500 performs a binding process without using a staple. Instead, the binding device 500 deforms the sheet stack T in the thickness direction and thereby binds the sheets S to one another. The binding device 500 is independent from the body frame 36 and is removable from the body frame 36.

The body 30 includes a sheet stack tray 70. The sheet stacks T, on which the binding processes have been performed by the stapler 40, and the sheet stacks T, on which the binding processes have been performed by the binding device 500, are stacked on the sheet stack tray 70. The sheet stack tray 70 is movable so as to be lowered in accordance the stacked amount of the sheet stacks T. When switching between the binding process between that performed by the stapler 40 and that performed by the binding device 500 or vice versa, the controller 80 changes the orientation of output image data so that the binding position is located in an upper part or in a left part of a double-page spread layout.

The binding device 500 will be described in detail. The binding device 500 performs the binding process by deforming the sheet stack T in the thickness direction.

Figure 2:
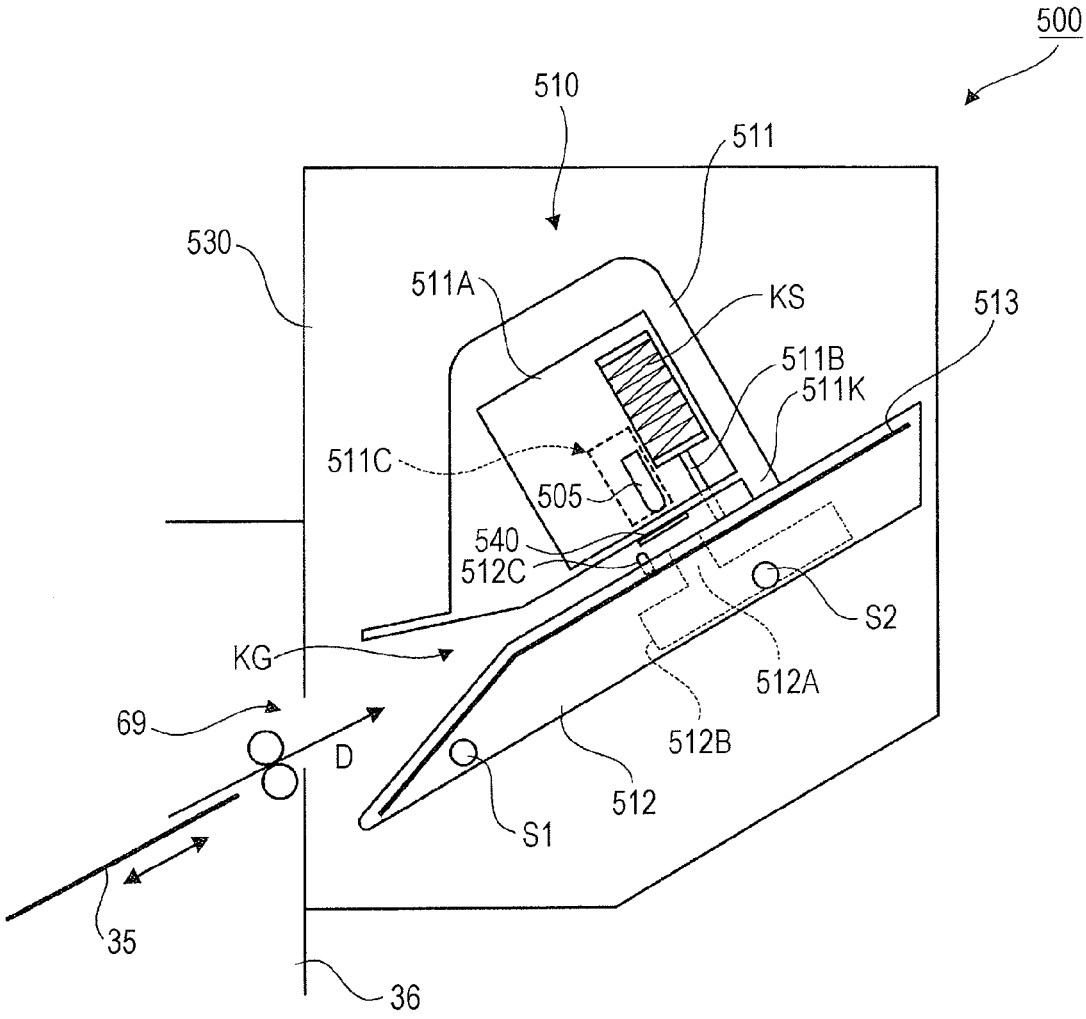
FIG. 2 illustrates a binding device.
Figure 3:
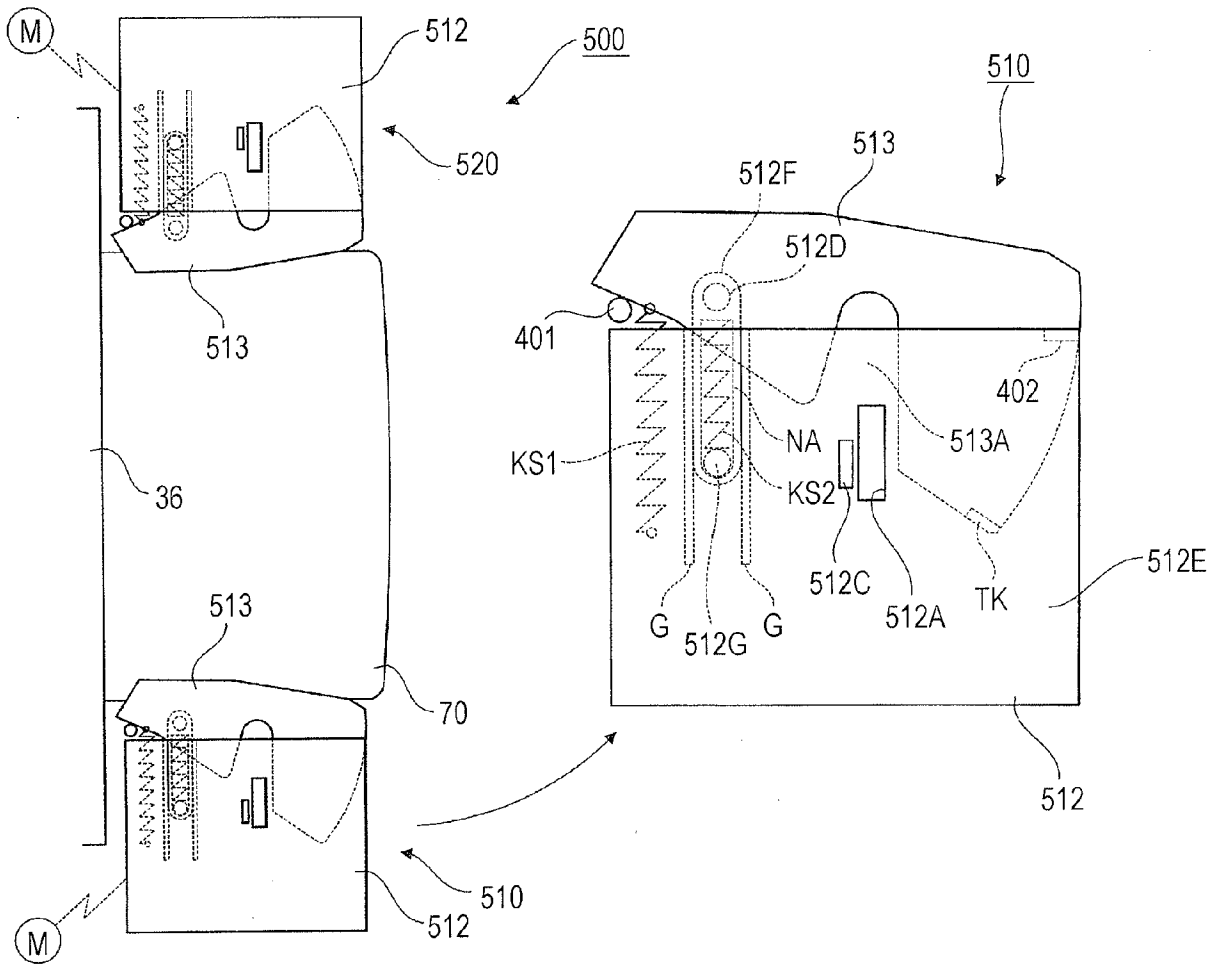
FIG. 3 illustrates the binding device.

FIGS. 2 and 3 illustrate the binding device 500. FIG. 2 illustrates the binding device 500 when viewed from the front side of the image forming system 1. FIG. 3 illustrates the binding device 500 when viewed from above the image forming system 1. In FIG. 3, a device frame 530 (described below) and an upper frame 511 (described below) are not illustrated.

As illustrated in FIG. 2, the binding device 500 includes the device frame 530 that has a box-like shape. The device frame 530 extends in a direction perpendicular to the transport direction of the sheet stack T (the depth direction of the image forming system 1). Although not illustrated, a bottom part of the device frame 530 that is in the middle of the device frame 530 in the longitudinal direction is open so that the sheet stack T placed on a rotary plate 513 (described below) may be dropped onto the sheet stack tray 70, as necessary.

The binding device 500 includes a first binding unit 510 and a second binding unit 520. FIG. 2 illustrates the first binding unit 510, which is disposed on the front side. As illustrated in FIG. 2, the first binding unit 510 is supported by the device frame 530 so as to be movable in a direction perpendicular to the transport direction of the sheet stack T (the depth direction of the image forming system 1). The first binding unit 510 moves to a middle portion or to one end of the sheet stack T, and binds the sheet stack T. The second binding unit 520 is disposed on the rear side (in a rear part of the image forming system 1). The second binding unit 520 is supported by the device frame 530 so as to be movable in a direction perpendicular to the transport direction of the sheet stack T. The second binding unit 520 moves to a middle portion or to the other end of the sheet stack T, and binds the sheet stack T.

The binding device 500 includes moving mechanisms (not shown) for moving the first binding unit 510 and the second binding unit 520. The moving mechanisms each include a motor M (see FIG. 3) and a guide (not shown), and move the first binding unit 510 and the second binding unit 520 in directions perpendicular to the transport direction of the sheet stack T. The present exemplary embodiment includes two motors M, which respectively correspond to the first binding unit 510 and the second binding unit 520. Instead of using two motors M, one motor M may move both the first binding unit 510 and the second binding unit 520 by using a rack and pinion mechanism.

The structures of the first binding unit 510 and the second binding unit 520 of the binding device 500 will be described. Because the first binding unit 510 and the second binding unit 520 have the same structure, the first binding unit 510 will be described here as an example.

As illustrated in FIG. 2, the first binding unit 510 includes the upper frame 511 and a lower frame 512. The lower frame 512 is disposed vertically below the upper frame 511 with a gap KG therebetween. The rotary plate 513 is disposed in the lower frame 512 of the first binding unit 510. The rotary plate 513 rotates around a predetermined shaft (described below).

As illustrated in FIG. 2, a movable frame 511A and a moving mechanism (not shown) are disposed in the upper frame 511. The movable frame 511A reciprocates in directions toward and away from the lower frame 512 (directions substantially normal to the surface of the lower frame 512).

The moving mechanism moves the movable frame 511A. A protruding member 511B and a coil spring KS are disposed in the movable frame 511A. The protruding member 511B protrudes toward the gap KG as the movable frame 511A moves toward the lower frame 512. The coil spring KS contracts when the protruding member 511B contacts the lower frame 512 and thereby prevents a breakage or the like of the protruding member 511B. A binding section 511C and a driving mechanism (not shown) are disposed in the movable frame 511A. The binding section 511C, which is an example of a binding member, performs a binding process on the sheet stack T by using a punching member 505 (described below in detail) and the like. The driving mechanism drives the punching member 505 and the like.

A sheet stack restriction member 540 (see also FIGS. 13A and 13B) is disposed on a side of the upper frame 511 facing the gap KG. The sheet stack restriction member 540 guides the sheet stack T so as to maintain a gap between the sheet stack T and the binding section 511C to restrict entry of the sheet stack T into the binding section 511C. The sheet stack restriction member 540 may be an independent member disposed on a surface of the upper frame 511, or may be integrally formed with a part of the surface of the upper frame 511.

As illustrated in FIG. 2, a hole 512A is formed in the lower frame 512, so that the punching member 505 disposed in the movable frame 511A may enter the hole 512A. A waste container 512B, which is continuous with the hole 512A, is formed in the lower frame 512. The waste container 512B contains waste that is generated when the binding section 511C of the upper frame 511 performs a binding process. As illustrated in FIG. 2, a protruding member 512C is formed on the upper surface of the lower frame 512 so as to protrude into the gap KG (see also FIG. 3).

As illustrated in FIG. 3, the binding device 500 is configured so that the rotary plate 513 is retractable into the lower frame 512. That is, the lower frame 512 has an outer frame including an upper plate 512E and a lower plate (not shown), and a recess is formed in a space between the upper plate 512E and the lower plate so that the rotary plate 513 is retractable into the recess. The rotary plate 513 is retracted into the recess when the first binding unit 510 and the second binding unit 520 are moved by a mechanism of the binding device 500 described below.

As illustrated in FIG. 3, the rotary plate 513 is configured so as to be rotatable around a shaft 512D that is disposed near the body frame 36. A first coil spring KS1 is disposed so that one end thereof is fixed to the rotary plate 513 at a position near the body frame 36 and the other end thereof is fixed to the lower surface of the upper plate 512E of the lower frame 512. Thus, a part of the rotary plate 513 positioned between the shaft 512D and the body frame 36 is pulled by the first coil spring KS1 toward the lower frame 512 (in a direction perpendicular to the transport direction of the sheet stack T).

The binding device 500 includes a supporting member 512F and a projecting pin 512G. A slot NA is formed in one end portion of the supporting member 512F, and the above-described shaft 512D is supported by the other end portion of the supporting member 512F. The projecting pin 512G projects from the lower surface of the upper plate 512E into the slot NA in the supporting member 512F. A second coil spring KS2 is disposed between the projecting pin 512G and the shaft 512D in the slot NA in the supporting member 512F. The second coil spring KS2 urges the supporting member 512F in a direction away from the projecting pin 512G. Guides G are formed on both sides of the supporting member 512F so as to guide the supporting member 512F when the supporting member 512F moves.

The binding device 500 includes a first restriction member 401 that restricts rotation of the rotary plate 513. The first restriction member 401 is disposed near the device frame 530 (see FIG. 2) so as to protrude into the rotation path of the rotary plate 513. A second restriction member 402 is disposed so as to protrude upward from the lower plate (not shown) of the lower frame 512. The second restriction member 402 restricts rotation of the rotary plate 513 by contacting a projection TK that is formed on the lower surface of the rotary plate 513.

The binding device 500 is configured so that the punching member 505 (see FIG. 2), which is included in the binding section 511C of the upper frame 511, enters the hole 512A formed in the lower frame 512. Therefore, the punching member 505 and the rotary plate 513 may interfere with each other. For this reason, as illustrated in FIG. 3, in the binding device 500, a cutout 513A is formed in the rotary plate 513 so as to prevent the interference between the punching member 505 and the rotary plate 513.

Figure 4A:
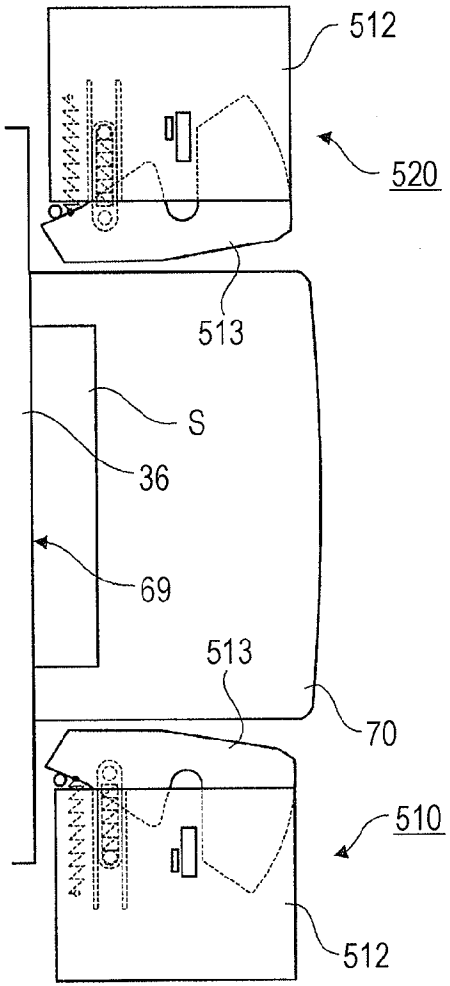
FIGS. 4A to 4C are top views of a first binding unit and a second binding unit.
Figure 4B:
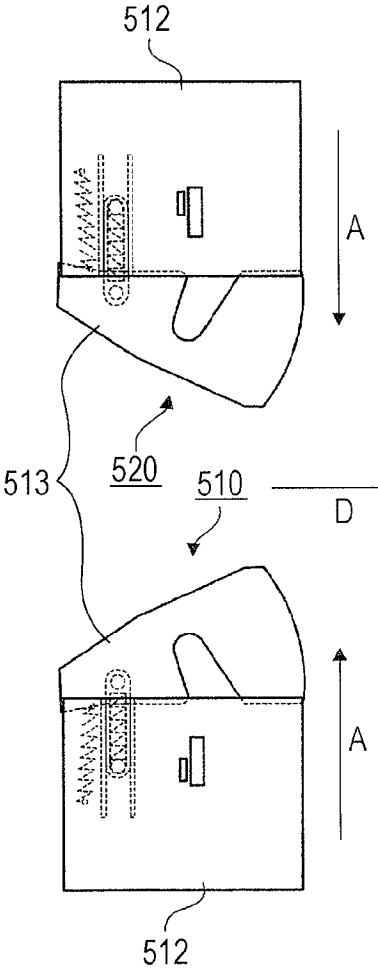
Figure 4C:
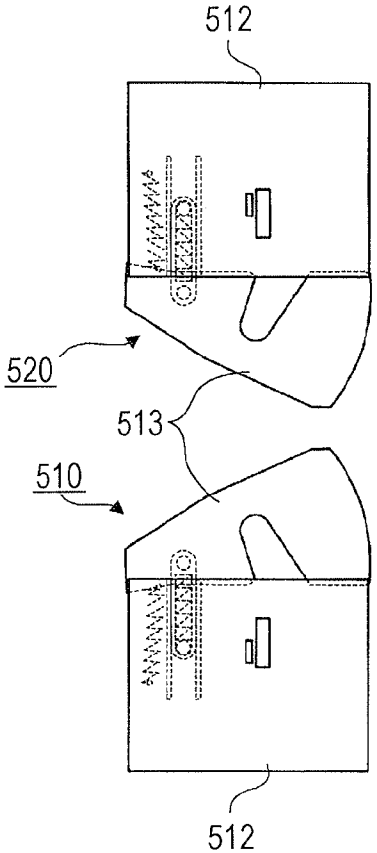
Figure 7:
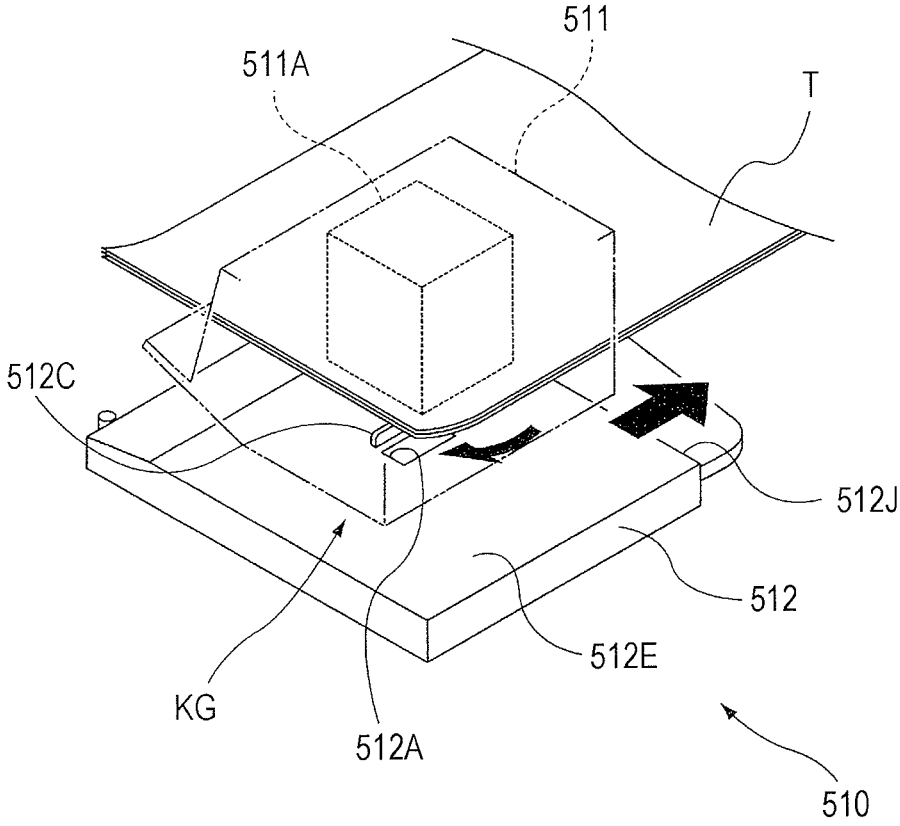
FIG. 7 is a perspective view of the first binding unit.
Figure 8A:
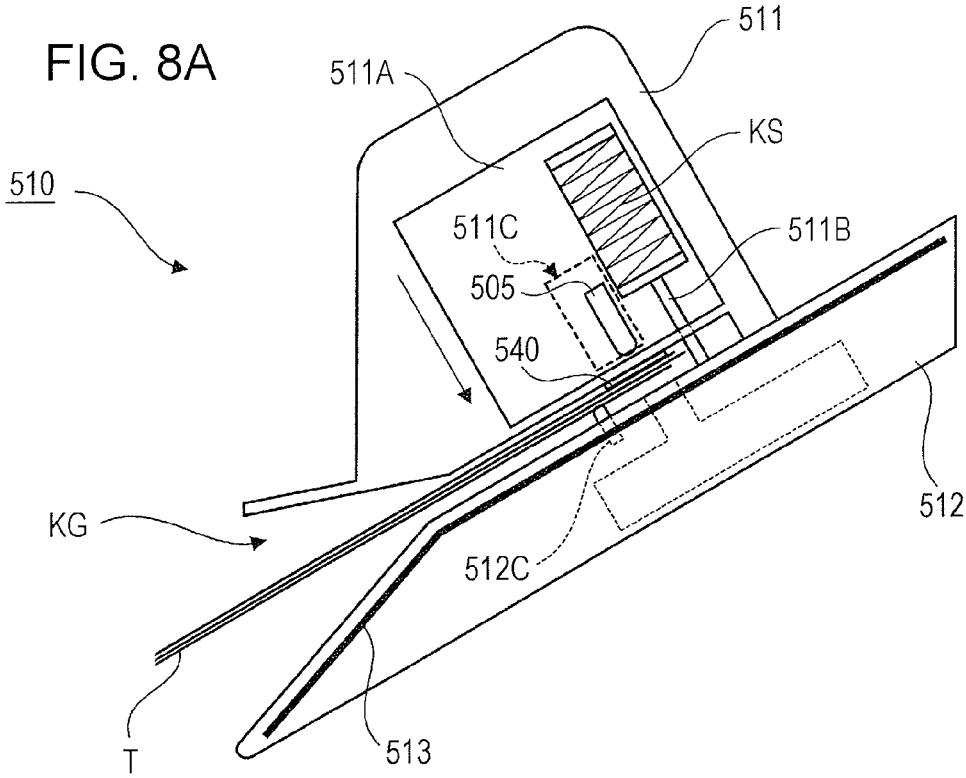
FIGS. 8A and 8B illustrate the first binding unit when viewed from the front side of the image forming system.
Figure 8B:
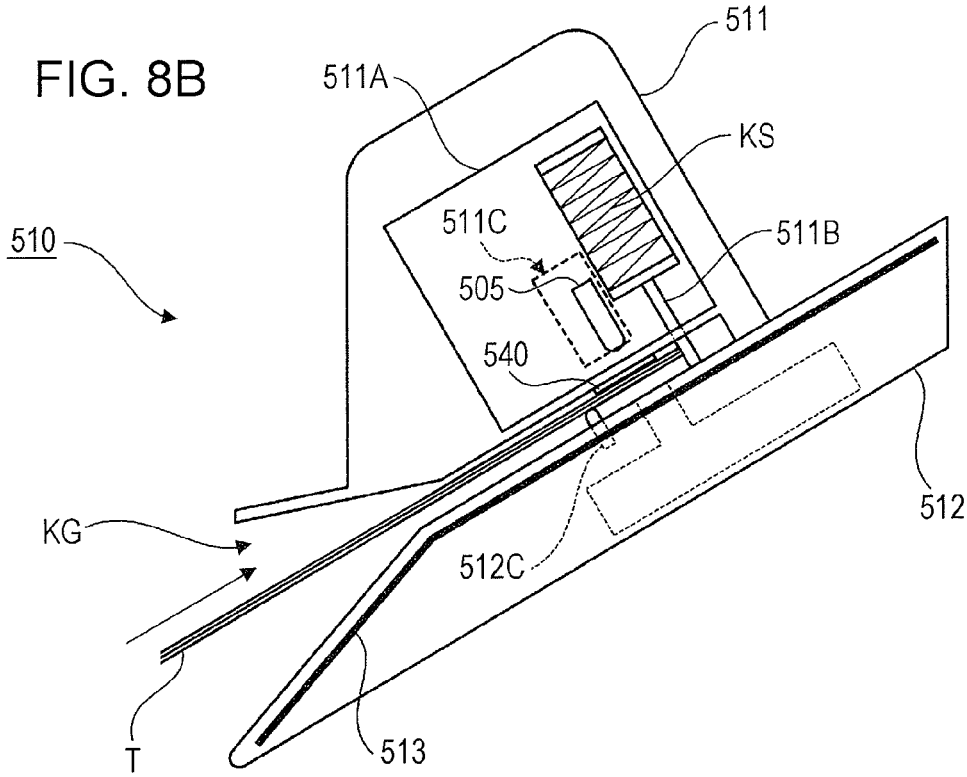
Figure 9:
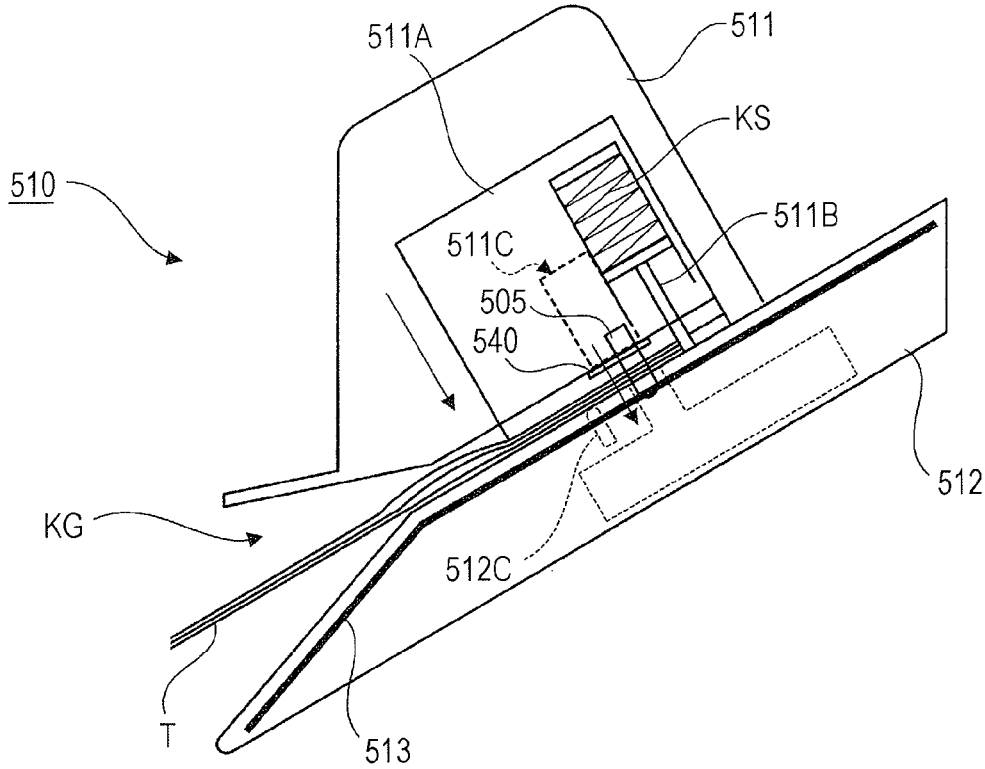
FIG. 9 illustrates the first binding unit when viewed from the front side of the image forming system.

The sheet processing apparatus 3 according to the present exemplary embodiment is capable of performing, in accordance with selection by a user, one or both of the following binding processes: a binding process using a staple, which is performed by the stapler 40; and a binding process by deforming the sheet stack T in the thickness direction, which is performed by the binding device 500. Hereinafter, with reference to FIGS. 4A to 10, the binding process performed by the stapler 40 and the binding process performed by the binding device 500 will be described. FIGS. 4A to 4C are top views of the first binding unit 510 and the second binding unit 520. FIGS. 5A to 7, and FIG. 10 are perspective views of the first binding unit 510 and other members. FIGS. 8A to 9 illustrate the first binding unit 510 when viewed from the front side of the image forming system 1.

The binding process performed by the stapler 40 will be described.

When the stapler 40 performs the binding process, the sheet stack tray 70 (see FIG. 1) is raised first. The exit rollers 34 (see FIG. 1) ejects the sheet S toward the sheet stacker 35, and plural sheets S are stacked on the sheet stacker 35. As illustrated in FIG. 4A, when the sheet S is ejected toward the sheet stacker 35, the leading end of the sheet S protrudes from an end portion 35C (see FIG. 1) of the sheet stacker 35 and through the opening 69 beyond the body frame 36. Even after the trailing end of the sheet S is placed on the sheet stacker 35 and the sheet S has slid over the sheet stacker 35 until the trailing end of the sheet S contacts the end guide 35B (see FIG. 1), the sheet S is stacked on the sheet stacker 35 such that the leading end of the sheet S protrudes from the body frame 36 (through the opening 69).

Therefore, in the present exemplary embodiment, the sheet stack tray 70 is first raised, so that sheet stack tray 70 supports the leading end of the sheet S, which protrudes from the body frame 36. In this state, the sheet S is supported by both of the sheet stacker 35 and the sheet stack tray 70. As described above, in the present exemplary embodiment, the entirety of the sheet S is not contained within the body frame 36. Instead, the sheet S is supported such that the leading end of the sheet S protrudes from the body frame 36. Thus, the size of the body frame 36 is reduced, and the footprint of the entirety of the image forming system 1 is reduced.

If the rotary plate 513 protrudes when the stapler 40 performs the binding process, the rotary plate 513 restricts movement of the sheet S and movement of the sheet stack T described below. Moreover, interference between the sheet stack tray 70 and the rotary plate 513 may occur while the sheet stack tray 70 is being raised. Therefore, in the present exemplary embodiment, as illustrated in FIG. 4A, when the stapler 40 performs the binding process, the first binding unit 510 is retracted toward the front side of the image forming system 1 and the second binding unit 520 is retracted toward the rear side of the image forming system 1. That is, the first binding unit 510 is retracted to one side of the transport path of the sheet stack T that is ejected from the sheet stacker 35 by the exit rollers 34 (see FIG. 1), and the second binding unit 520 is retracted to the other side of the transport path of the sheet stack T.

While the exit rollers 34 is successively ejecting the sheets S onto the sheet stacker 35, the tampers 38 (see FIG. 1) press the side edges of the sheets S. Thus, the sheets S are aligned in the width direction. Moreover, the rotating paddle 37 (see FIG. 1) presses the sheets S against the end guide 35B, whereby the sheets S are aligned in the transport direction. Thus, the sheet stack T, which includes a predetermined number of the sheets S whose ends in the width direction and the transport direction are aligned, is generated on the sheet stacker 35. Subsequently, the stapler 40 performs the binding process on the sheet stack T. Then, the eject roller 39 ejects the sheet stack T onto the sheet stack tray 70. The present exemplary embodiment is configured so that the sheet stack tray 70 is lowered in accordance with the stacked amount of the sheet stacks T as the sheet stacks T are stacked onto the sheet stack tray 70.

The binding process performed by the binding device 500, in which the sheet stack T is bound by deforming the sheet stack T in the thickness direction, will be described.

Figure 5A:
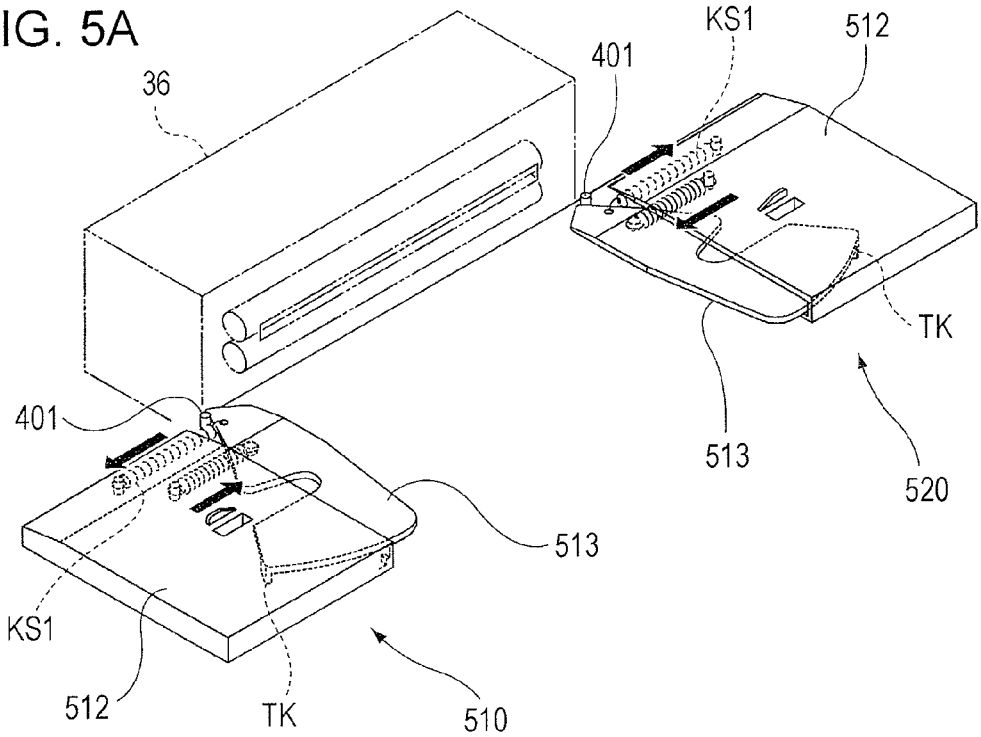
FIGS. 5A and 5B are perspective views of the first binding unit and the second binding unit.
Figure 5B:
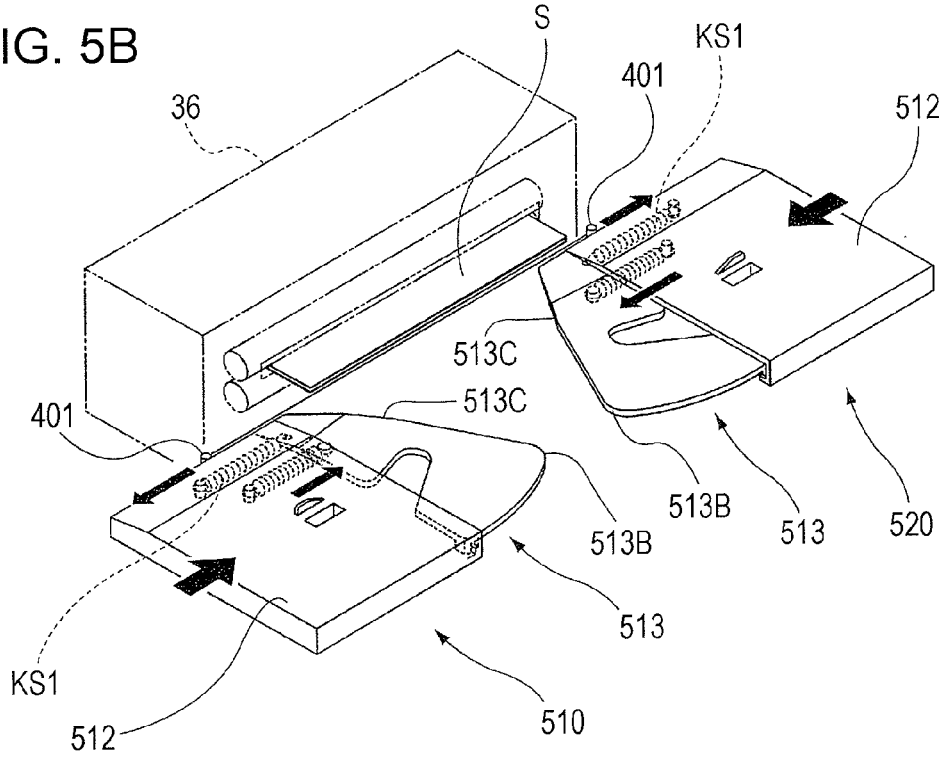

When the binding device 500 performs the binding process, the sheet stack tray 70 is lowered to a position at which interference between the sheet stack tray 70 and the first and second binding units 510 and 520 does not occur. Subsequently, as indicated by arrows A in FIG. 4B, the first binding unit 510 and the second binding unit 520 move toward a stacked area of the sheet stack T in directions in which the first and second binding units 510 and 520 become close to each other (in directions perpendicular to a transport direction D of the sheet stack T). As the first binding unit 510 and the second binding unit 520 move, restriction on the rotary plates 513 (see FIG. 5A) by the first restriction members 401 is released. Thus, the rotary plates 513 rotate due to the first coil springs KS1, and the rotary plates 513 protrude from the lower frames 512 as illustrated in FIG. 5B. When the rotary plates 513 protrude, the leading end (see FIG. 5B) of the sheet S that protrudes from the body frame 36 is supported by the rotary plates 513. That is, when the binding device 500 performs the binding process, the sheets S, which are successively transported by the exit rollers 34, are supported by both of the sheet stacker 35 and the rotary plate 513. The sheet stacker 35 and the rotary plate 513 constitute a recording medium stacking member.

The rotary plates 513 rotate due to the first coil springs KS1, and the rotation is stopped when the projections TK (see FIG. 5A), which are formed on the rotary plates 513, contact the second restriction members 402 (see FIG. 3), which are formed on the lower frames 512. When the sheets S are successively transported toward the sheet stacker 35 by the exit rollers 34, the rotary plates 513 are disposed downstream of the sheets S in the transport path. As illustrated in FIG. 5B, the lower frames 512 are disposed outside the transport path (on lateral sides of the transport path). Although not illustrated, the upper frames 511 are also disposed outside the transport path (on lateral sides of the transport path). Thus, the upper frames 511 and the lower frames 512 of the first binding unit 510 and the second binding unit 520 do not impede transportation of the sheet S by the exit rollers 34 to the sheet stacker 35.

The upper frames 511 and the lower frames 512 may be disposed in the transport path along which the sheets S are successively transported toward the sheet stacker 35 by the exit rollers 34. In this case, although it may depend on the size of the sheet S, the sheet S, which has been transported by the exit rollers 34, temporarily enters the gap KG (see FIG. 2) between the upper frames 511 and the lower frames 512. Then, the sheet S slides over the sheet stacker 35 and the rotary plate 513 and moves toward the end guide 35B (see FIG. 1) of the sheet stacker 35.

The sheets S, which are successively transported to the sheet stacker 35, may have been curled (warped). If such a curled sheet S enters the gap KG in the binding device 500, the sheet S may catch on the lower surface of the upper frame 511 or the upper surface of the lower frame 512, whereby transportation of the sheet S toward the end guide 35B may be restricted. Moreover, the sheets S included in the sheet stack T may become uneven.

If the sheets S have been already stacked on the sheet stacker 35, a new sheet S that is additionally transported to the sheet stacker 35 slides over the upper surface of the stack of sheets S, which have been already stacked on the sheet stacker 35 and the rotary plate 513, and then enters the gap KG in the binding device 500. When the additional sheet S slides over the stacked sheet S, it is very likely that the sheet S may contact the lower surface of the upper frame 511 in the gap KG. Moreover, also in this case, transportation of the sheet S toward the end guide 35B may be impeded.

Therefore, in the present exemplary embodiment, as described above, when the sheets S are successively transported toward the sheet stacker 35, the first binding unit 510 and the second binding unit 520, each including the upper frame 511 and the lower frame 512, are retracted to positions outside the transport path of the sheets S. That is, the first binding unit 510 is retracted to a position on one side of the transport path of the sheet S (in a direction perpendicular to the transport path), and the second binding unit 520 is retracted to the other side of the transport path of the sheet S.

When a predetermined number of sheets S have been stacked as the sheet stack T that is supported by both of the sheet stacker 35 and the rotary plate 513 and when ends of the sheets S in sheet stack T have been aligned in the width direction and in the transport direction, the sheet stacker 35 is slid toward the binding device 500. Thus, the leading end of the sheet stack T on the sheet stacker 35 is moved to a position at which the first binding unit 510 and the second binding unit 520 perform the binding processes. Subsequently, the first binding unit 510 and the second binding unit 520 are moved in directions A perpendicular to the transport path D of the sheet S (the width directions of the sheet stack T), so that the first binding unit 510 and the second binding unit 520 are located at predetermined binding positions in the directions A perpendicular to the transport path D of the sheet S.

Although not described above, the rotary plate 513, which is included in each of the first binding unit 510 and the second binding unit 520, has a triangular shape as illustrated in FIG. 3. As illustrated in FIG. 5B, a vertex 513B of the rotary plate 513 of one of the first binding unit 510 and the second binding unit 520 protrudes toward the other of the first binding unit 510 and the second binding unit 520 when the rotary plate 513 is positioned in the transport path of the sheet S. Each of the rotary plate 513 has an edge 513C that is continuous with the vertex 513B, and the edge 513C is inclined toward the lower frame 512 with decreasing distance from the body frame 36.

FIGS. 4B and 5B illustrate the positions of the first binding unit 510 and the second binding unit 520 when, for example, an A4-sized sheet S is transported with a long edge acting as the leading edge (so-called "long edge feed": LEF). If, for example, the sheet S that is A4-sized is transported with a short edge acting as the leading edge (so-called "short edge feed": SEF), the first binding unit 510 and the second binding unit 520 are positioned closer to each other as illustrated in FIG. 4C. Although not described above, in the binding device 500 according to the present exemplary embodiment, the first binding unit 510 and the second binding unit 520 are disposed so that the rotary plates 513 are positioned on the extension of the transport path D of the sheet S in the sheet stacker 35, as illustrated in FIG. 2.

The binding process performed by the binding device 500 will be further described. As in the binding process performed by the stapler 40, when the sheets S are ejected to the sheet stacker 35, the tampers 38 press the side edges of the sheets S so as to align the sheets S in the width direction. Moreover, the rotating paddle 37 presses the sheets S against the end guide 35B so as to align the sheets S in the transport direction. Thus, the sheet stack T, including the sheet S whose ends in the width direction and the transport direction are aligned, is generated on the sheet stacker 35. Subsequently, the sheet stacker 35 slides along the transport path D of the sheet S toward the binding device 500 (see also FIG. 2). Thus, the leading end of the sheet stack T on the sheet stacker 35 moves to a predetermined position at which the first binding unit 510 and the second binding unit 520 performs the binding process.

Figure 6A:
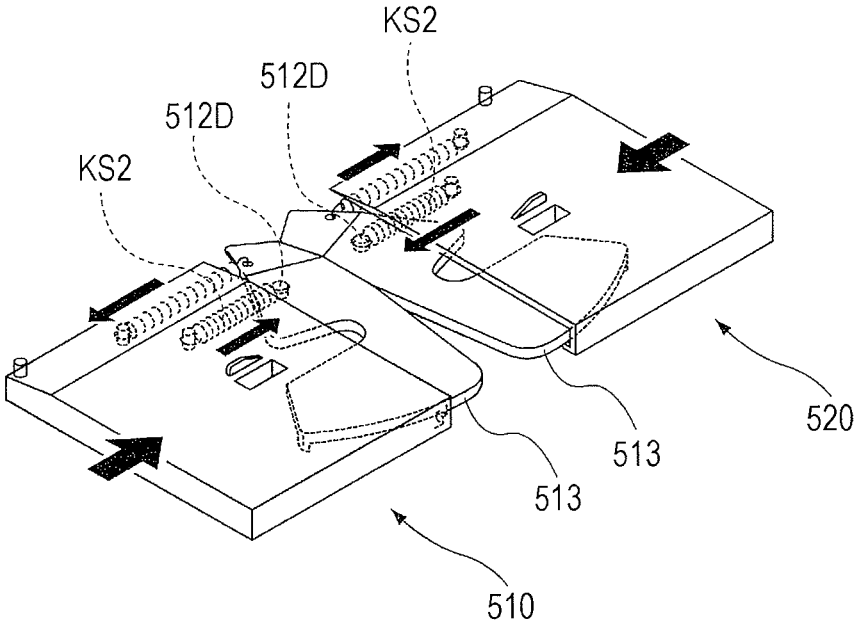
FIGS. 6A and 6B are perspective views of the first binding unit and the second binding unit.
Figure 6B:
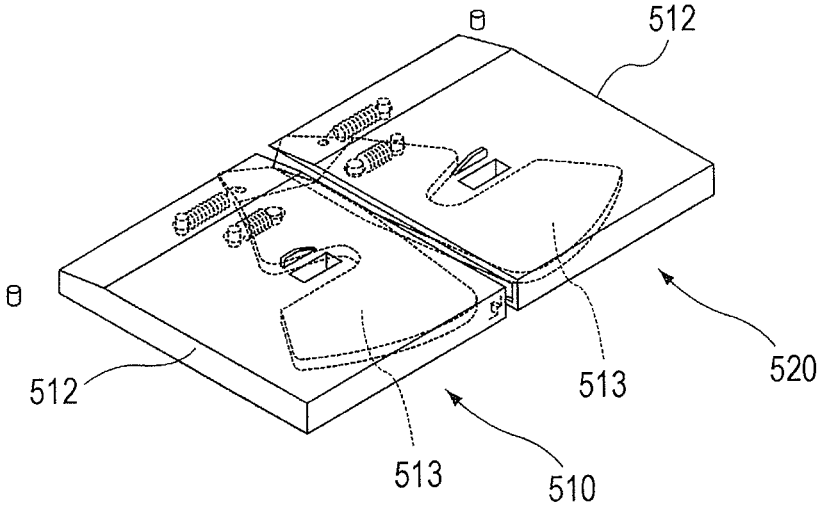

When, for example, performing the binding process at two positions that are in the middle portion of the sheet S (the middle portion with respect to a direction perpendicular to the transport direction of the sheet S), as illustrated in FIG. 6A, the first binding unit 510 and the second binding unit 520 move closer to each other in directions perpendicular to the transport path D of the sheet S (see FIG. 4B) (the directions indicated by arrows in FIG. 6A) so as to enter the stacked area of the sheet stack T that is supported by the sheet stacker 35 and the rotary plate 513. At this time, as illustrated in FIG. 6A, the rotary plates 513 of the first binding unit 510 and the rotary plate 513 of the second binding unit 520 contact each other. The rotary plates 513 rotate around the shaft 512D. As the first binding unit 510 and the second binding unit 520 become closer to each other, the second coil spring KS2 disposed in the supporting member 512F (see FIG. 3) contracts and the rotary plates 513 slide. Thus, as illustrated in FIG. 6B, the rotary plates 513 of the first binding unit 510 and the second binding unit 520 are retracted into the lower frames 512.

If the rotary plates 513 of the first binding unit 510 and the second binding unit 520 are not rotatable, the rotary plate 513 of the first binding unit 510 and the rotary plate 513 of the second binding unit 520 interfere with each other, so that it is difficult to move the first binding unit 510 and the second binding unit 520 sufficiently close to each other. Therefore, in the present exemplary embodiment, the rotary plates 513 are configured to be rotatable and slidable as described above. Thus, the first binding unit 510 and the second binding unit 520 are movable to positions at which the first and the second binding units 510 and 520 are capable of performing the binding process on the middle portion of the sheet S.

The first binding unit 510 and the second binding unit 520 are moved in directions (indicated by arrows in FIGS. 5A to 6B) in which the first binding unit 510 and the second binding unit 520 become closer to each other and enter a stacked area of the sheet stack T that is supported by the sheet stacker 35 and the rotary plate 513. Thus, as illustrated in FIG. 7, in each of the first binding unit 510 and the second binding unit 520, the sheet stack T is positioned in the gap KG between the upper frame 511 and the lower frame 512. As described above, the hole 512A is formed in the upper surface of the lower frame 512 (see also FIG. 3). Therefore, when the first binding unit 510 and the second binding unit 520 are moved in directions in which the first binding unit 510 and the second binding unit 520 become closer to each other, the sheet stack T, which enters the gap KG in each of the first and second binding units 510 and 520, may catch in the hole 512A in the lower frame 512.

Therefore, each of the first binding unit 510 and the second binding unit 520 includes the protruding member 512C that protrudes from the upper surface of the lower frame 512 into the gap KG (see also FIG. 2). Thus, when the sheet stack T enters the gaps KG in the lower frames 512 due to the movement of the first binding unit 510 and second binding unit 520, the protruding members 512C serves to lift the sheet stack T above the upper surface of the lower frame 512. Thus, the sheet stack T is prevented from catching in the hole 512A in the lower frame 512. In order that the sheet stack T smoothly enters the gap KG, an end portion 512J of the upper plate 512E of the lower frame 512 and the protruding member 512C are chamfered.

After the rotary plates 513 have been retracted into the lower frame 512 (as illustrated in FIG. 6B), the movable frame 511A disposed in the upper frame 511 is moved toward the lower frame 512 by a predetermined distance, as illustrated in FIG. 8A. Thus, the protruding members 511B protrude into the gaps KG in the first binding unit 510 and the second binding unit 520. Subsequently, the eject roller 39 (see FIG. 1), which has been stopped, is rotated again. Thus, as illustrated in FIG. 8B, the leading end of the sheet stack T is pressed against the protruding member 511B, whereby the leading end of the sheet stack T is aligned.

Next, as illustrated in FIG. 9, the movable frame 511A is moved further toward the lower frame 512, so that the leading end of the sheet stack T is pressed by the lower surface of the movable frame 511A and the upper surface of the lower frame 512. At this time, the protruding member 512C, which has been protruding from the upper surface of the lower frame 512, is pressed by the movable frame 511A through the sheet stack T, whereby the protruding member 512C is retracted from the gap KG into the lower frame 512.

Next, as illustrated in FIG. 9, the punching member 505 disposed in the movable frame 511A penetrates into the sheet stack T, and the binding process is performed on the sheet stack T. Thus, the binding process on the middle portion of the sheet stack T is finished. Subsequently, the first binding unit 510 and the second binding unit 520 move in directions in which the first binding unit 510 and the second binding unit 520 become separated from each other so that the first binding unit 510 and the second binding unit 520 are retracted to the outside of the stacked area of the sheet stack T that is supported by the sheet stacker 35 and the rotary plate 513. Then, each of the first binding unit 510 and the second binding unit 520 enters a state illustrated in FIG. 10. That is, the first binding unit 510 is disposed at a position at which the first binding unit 510 faces one end of the sheet stack T, and the second binding unit 520 is disposed at a position at which the second binding unit 520 faces the other end of the sheet stack T.

Figure 10:
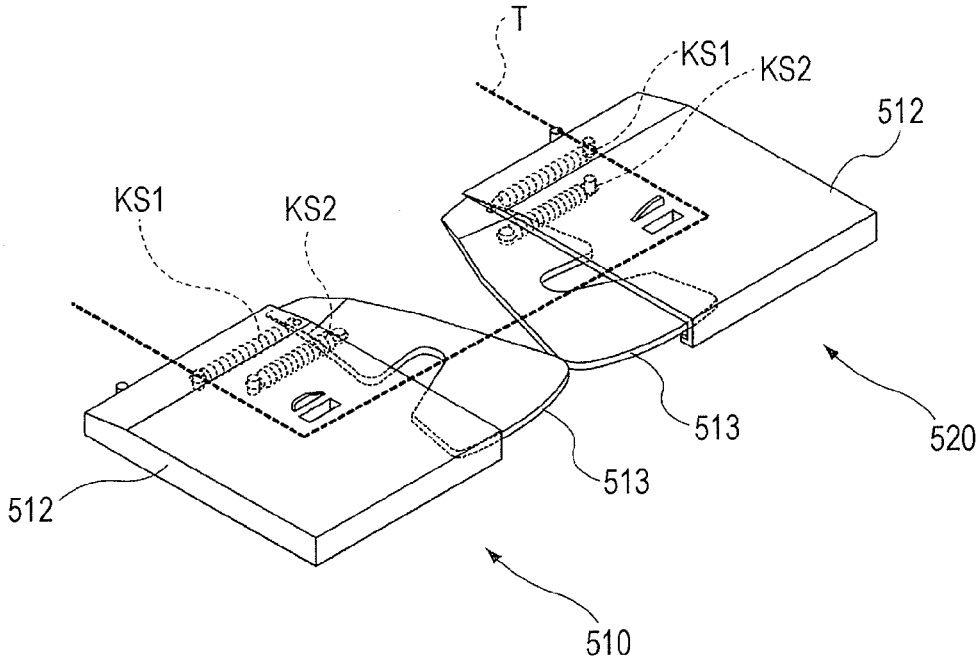
FIG. 10 is a perspective view of the first binding unit and the second binding unit.

When the first binding unit 510 and the second binding unit 520 move in the directions in which the first binding unit 510 and the second binding unit 520 become separated from each other, the rotary plate 513 in each of the first binding unit 510 and the second binding unit 520 is pressed by the second coil spring KS2 and an end portion of the rotary plate 513 is pulled by the first coil spring KS1. Thus, as illustrated in FIG. 10, the rotary plates 513 protrude from the lower frames 512. Thus, even when the first binding unit 510 and the second binding unit 520 move in the direction in which the first binding unit 510 and the second binding unit 520 become separated from each other, the rotary plates 513 continue to support the sheet stack T.

Subsequently, the operation the same as that illustrated in FIG. 9 is performed again, and the binding process is performed on end portions of the sheet stack T. As a result, in the present exemplary embodiment, the binding process is performed at four positions. Instead of performing the binding process at four positions as described above, the binding process may be performed at only two positions in the middle portion. Alternatively, the binding process may be performed at only one position, i.e., one end of the sheet stack T.

Subsequently, in the present exemplary embodiment, the first binding unit 510 and the second binding unit 520 are moved in a direction in which the first binding unit 510 and the second binding unit 520 become separated from each other. Thus, the rotary plate 513 disposed in each of the first binding unit 510 and the second binding unit 520 is pressed by the second coil spring KS2, and the end portion of the rotary plate 513 is pulled by the first coil spring KS1, whereby the end portion protrudes from the lower frame 512. As a result, the first binding unit 510 and the second binding unit 520 return to the state illustrated in FIG. 5B, in which the first binding unit 510 and the second binding unit 520 are retracted to the outside of the stacked area of the sheet stack T.

That is, after the binding process has been finished, the first binding unit 510 and the second binding unit 520 are disposed so that the rotary plates 513 are positioned below the sheet stack T and so that the upper frames 511 and the lower frames 512 are retracted to the lateral sides of the sheet stack T. In the present exemplary embodiment, as will be described below, after the binding device 500 has finished the binding process, the eject roller 39 transports the sheet stack T and drops the sheet stack T onto the sheet stack tray 70 through the opening formed in a lower part of the device frame 530 (see FIG. 2). Therefore, if the upper frame 511 and the lower frame 512 are positioned above the transport path of the sheet stack T, the sheet stack T collides with a base 511K (see FIG. 2) of the upper frame 511 and transportation of the sheet stack T is impeded. For this reason, in the present exemplary embodiment, when the binding process has been finished, the upper frame 511 and the lower frame 512 are retracted to the lateral sides of the sheet stack T.

Subsequently, the eject roller 39 starts rotating and ejects the sheet stack T, on which the binding process performed by the binding device 500 has been finished. To be more specific, the eject roller 39 transports the sheet stack T until the trailing end of the sheet stack T passes through the opening 69 (see FIG. 1). Thus, the sheet stack T, which has been supported by both of the sheet stacker 35 and the rotary plate 513, is supported by only the rotary plate 513.

In the present exemplary embodiment, the rotary plate 513 is inclined as with the sheet stacker 35. Therefore, the sheet stack T, which has been transported by the eject roller 39 to the rotary plate 513, may return to the sheet stacker 35. To prevent this, as illustrated in FIG. 2, an upstream part of the rotary plate 513 with respect to the transport direction of the sheet stack T has a steeper slope. That is, the upstream part of the rotary plate 513 with respect to the transport direction of the sheet stack T has a slope that is steeper than the slope of a downstream part with respect to the transport direction of the sheet stack T and the slope of a middle part with respect to the transport direction of the sheet stack T. To be specific, the upstream part of the rotary plate 513 with respect to the transport direction of the sheet stack T is formed so as to hang downward. As illustrated in FIG. 2, the upstream end of the rotary plate 513 with respect to the transport direction of the sheet stack T is positioned below the opening 69. Thus, in the present exemplary embodiment, the binding device 500 is configured so that the sheet stack T placed on the rotary plate 513 does not readily return to the sheet stacker 35.

After the eject roller 39 has transported the sheet stack T onto the rotary plate 513, in the binding device 500 according to the present exemplary embodiment, the first binding unit 510 and the second binding unit 520 are moved in directions in which the first and second binding units 510 and 520 become away from each other. When the first binding unit 510 and the second binding unit 520 are moved further, support of the sheet stack T by the rotary plates 513 is released. Thus, the sheet stack T drops through the opening formed in the device frame 530 (see FIG. 2), and the sheet stack T is stacked onto the sheet stack tray 70 below.

In the binding device 500 according to the present exemplary embodiment, the rotary plate 513 has the edge 513C (see FIG. 5B). As illustrated in FIG. 5B, the edge 513C is inclined toward the lower frame 512 with decreasing distance from the body frame 36. Therefore, in the state illustrated in FIG. 5B, a gap between the rotary plate 513 of the first binding unit 510 and the rotary plate 513 of the second binding unit 520 increases with decreasing distance from the body frame 36. That is, the gap between the rotary plate 513 of the first binding unit 510 and the rotary plate 513 of the second binding unit 520 increases toward the trailing end of the sheet stack T placed on the rotary plate 513.

Moreover, in the binding device 500 according to the present exemplary embodiment, the gap between the rotary plate 513 of the first binding unit 510 and the rotary plate 513 of the second binding unit 520 is the smallest at a position corresponding to the vertices 513B (see FIG. 5B) of the rotary plates 513. The gap between the rotary plates 513 increases from the position corresponding to the vertices 513B toward the body frame 36. Thus, when the sheet stack T drops as the first binding unit 510 and the second binding unit 520 moves away from each other, the trailing end of the sheet stack T drops first. That is, the trailing end of the sheet stack T contacts the sheet stack tray 70 before the leading end does.

As the stacked amount of the sheet stacks T on the sheet stack tray 70 increases, the sheet stack tray 70 is lowered. Although not described above, as illustrated in FIG. 2, the lower frame 512 includes a first sensor S1 and a second sensor S2 for detecting the sheet stack T on the sheet stack tray 70. While at least one of the first sensor S1 and the second sensor S2 is detecting the sheet stack T, the sheet stack tray 70 is continued to be lowered. When none the first sensor S1 and the second sensor S2 detects the sheet stack T, the sheet stack tray 70 is stopped. Thus, interference between the rotary plate 513 and the sheet stack T on the sheet stack tray 70 is avoided. Moreover, the sheet stack T is prevented from being positioned above the opening 69 in the body frame 36 when the stapler 40 performs the binding process.

Each of the first sensor S1 and the second sensor S2 is a transmissive sensor. The transmissive sensor includes a light emitter (not shown) disposed in the lower frame 512 of the first binding unit 510 and a light receiver (not shown) disposed in the lower frame 512 of the second binding unit 520. That is, the light emitters of the first sensor S1 and the second sensor S2 are disposed in the lower frame 512 of the first binding unit 510 and the light receivers of the first sensor S1 and the second sensor S2 are disposed in the lower frame 512 of the second binding unit 520.

Figure 11B:
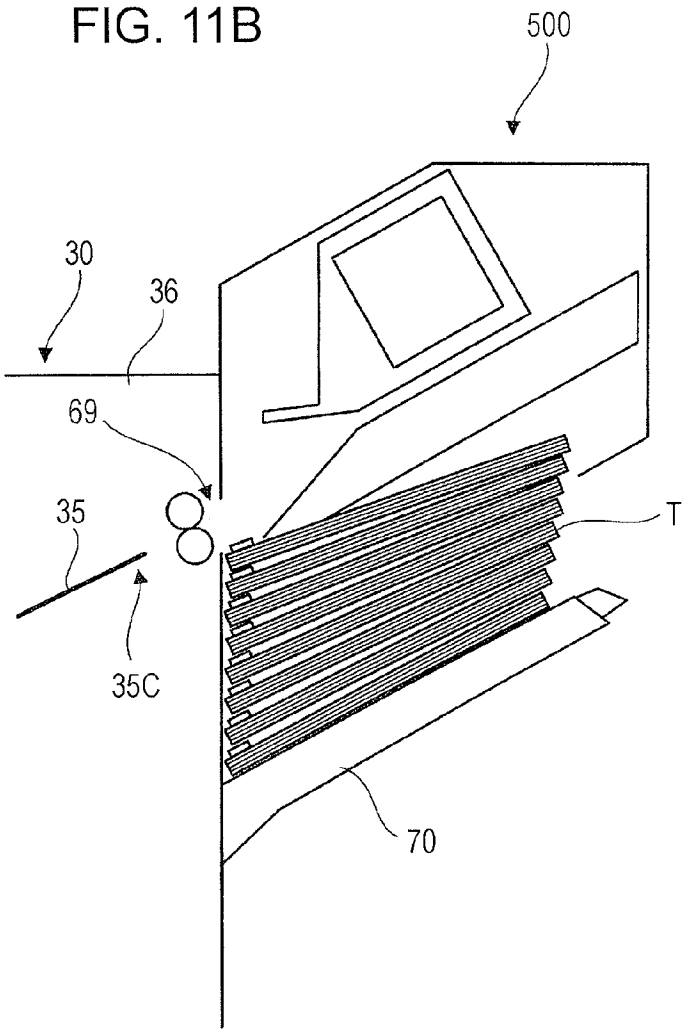
FIGS. 11A and 11B illustrate how sheet stacks are outputted.
Figure 11A:
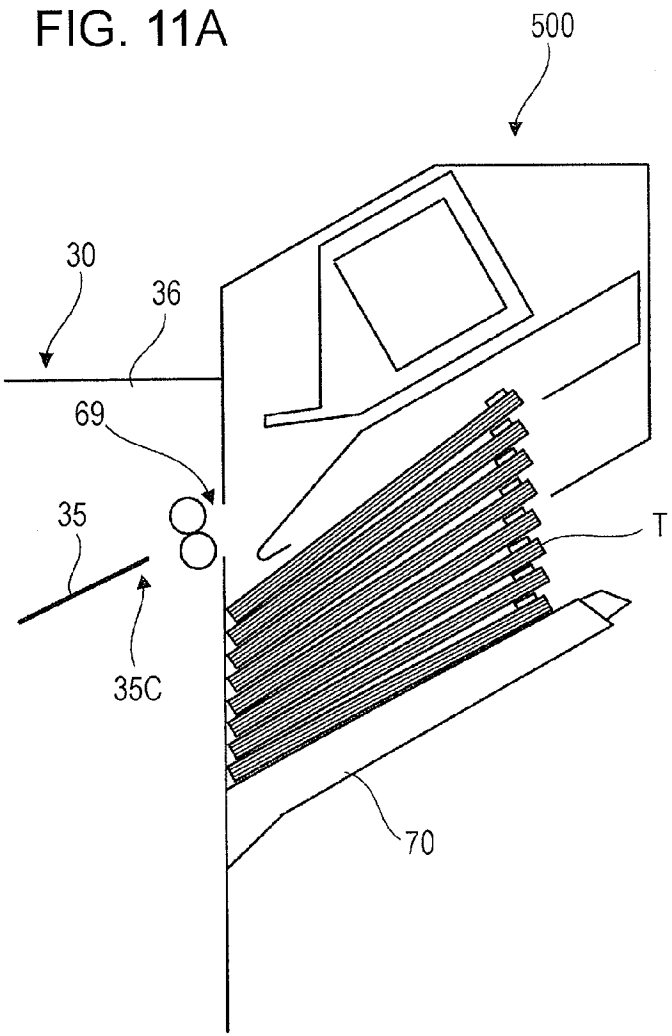

When the binding process is performed on the sheet stack T, a protruding portion formed in a leading end portion or a trailing end portion of the sheet stack T due to a staple of the stapler 40 or due to a flap 522 (see FIGS. 12A and 12B) formed by the binding device 500. As illustrated in FIGS. 11A and 11B (which illustrates how the sheet stacks are stacked), when the sheet stacks T are stacked onto the sheet stack tray 70, the height of the sheet stacks T (stack height) at the leading end of the sheet stacks T becomes different from the height at the trailing end of the sheet stacks T. FIG. 11A illustrates a state in which the sheet stacks T whose leading ends have been bound are stacked, and FIG. 11B illustrates a state in which the sheet stacks T whose trailing ends have been bound are stacked.

Without using both of the first sensor S1 and the second sensor S2, only the first sensor S1, for example, may be used to detect the sheet stack T on the sheet stack tray 70. However, in this case, lowering of the sheet stack tray 70 may be stopped even when the stack height of the sheet stacks T is large at the leading end of the sheet stacks T. That is, lowering of the sheet stack tray 70 may be stopped even when interference between the leading end of the sheet stack T and the rotary plate 513 may occur. Alternatively, only the second sensor S2, for example, may detect the sheet stacks T on the sheet stack tray 70. However, in this case, lowering of the sheet stack tray 70 may be stopped even when the stack height of the sheet stacks T is large at the trailing end of the sheet stacks T. That is, lowering of the sheet stack tray 70 may be stopped even when interference between the trailing end of the sheet stacks T and the rotary plate 513 may occur. Therefore, in the present exemplary embodiment, the first sensor S1 for detecting the trailing end of the sheet stacks T and the second sensor S2 for detecting the leading end of the sheet stack T are provided, and the sheet stack tray 70 is stopped when the sheet stack T is not detected by the first sensor S1 and the second sensor S2.

Figure 12A:
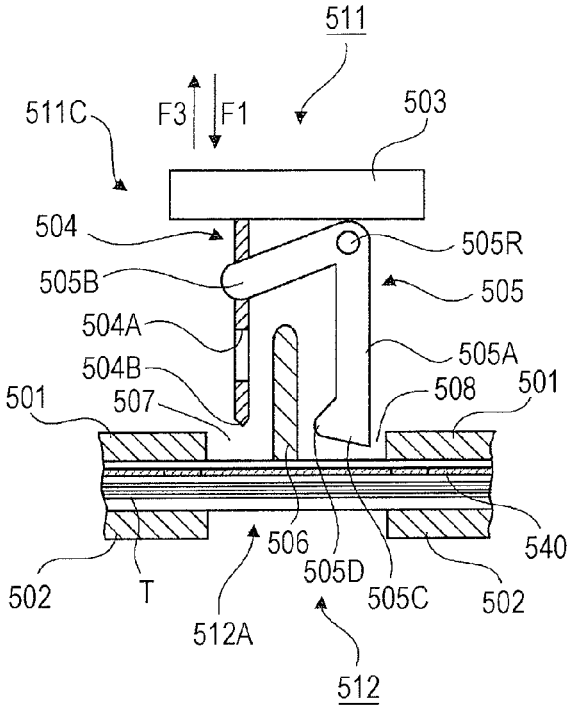
FIGS. 12A to 12D illustrate a binding unit disposed in an upper frame.

The binding section 511C (see FIG. 2), which is disposed in the upper frame 511 of each of the first binding unit 510 and the second binding unit 520, will be described. FIG. 12A illustrates the binding section 511C disposed in the upper frame 511. FIG. 12A also illustrates a part of the lower frame 512 of each of the first binding unit 510 and the second binding unit 520.

As illustrated in FIG. 12A, the binding section 511C, which is an example of a binding member, is disposed in the upper frame 511 of each of the first binding unit 510 and the second binding unit 520. The binding section 511C includes a movable member 503 that is movable in directions (indicated by F1 and F3) normal to a base 501 of the upper frame 511, which is a part of the upper frame 511 facing the lower frame 512. A blade 504 and the punching member 505 are disposed between the movable member 503 and the lower frame 512.

The base 501 of the upper frame 511 extends parallel to a bottom member 502 of the lower frame 512, which is a part of the lower frame 512 facing the upper frame 511. A protruding portion 506 is formed on the base 501, and openings 507 and 508 are formed in the base 501. The protruding portion 506 is formed at a position corresponding to the hole 512A (see FIG. 2) in the bottom member 502 of the lower frame 512 so as to protrude toward the movable member 503. The opening 507 allows the blade 504 of the movable member 503 to passes therethrough. The opening 508 allows the punching member 505 of the movable member 503 to pass therethrough.

The blade 504 of the movable member 503, which is a rectangular plate having a sharp leading edge 504B at one end thereof, creates a slit-shaped (linear) opening in the sheet stack T. That is, the movable member 503 moves toward the base 501, and the blade 504 cuts the sheet stack T to create a slit opening 521 illustrated in FIG. 12B.

The punching member 505 of the movable member 503 cuts the sheet stack T to create the flap 522, which is a tongue-shaped cut portion. The flap 522 is an example of a deformed portion.

As illustrated in FIG. 12A, the punching member 505 is a substantially L-shaped member having a bent portion. The punching member 505 is swingable around a rotation shaft 505R. That is, the punching member 505, which is substantially L-shaped, has a first portion 505A at one end thereof and a second portion 505B at the other end thereof. When the movable member 503 moves toward the base 501, the protruding portion 506 of the base 501 pushes up the second portion 505B, and thereby the first portion 505A swings around the rotation shaft 505R toward the blade 504.

Figure 12B:
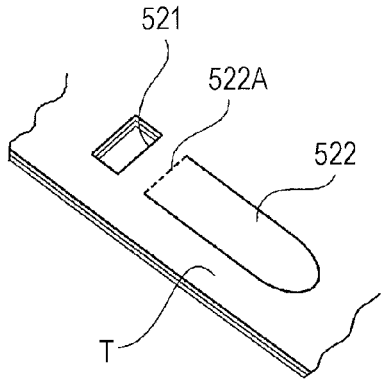

The first portion 505A has a sharp blade portion 505C at an end edge opposite to the rotation shaft 505R of the first portion 505A, i.e., at an end edge near the base 501. Thus, the first portion 505A swings so as to be inclined toward the blade 504, and the end of the first portion 505A near the base 501 is pressed into the sheet stack T in the thickness direction, whereby the flap 522, which is a tongue-shaped slit, is formed in the sheet stack T. The blade portion 505C is not formed in a part of the end edge of the first portion 505A near the base 501, the part facing the blade 504. Therefore, as illustrated in FIG. 12B, an end portion 522A of the flap 522 of the sheet stack T is not cut, so that the flap 522 is connected to the sheet stack T at the end portion 522A, which is formed on the blade 504 side.

When the second portion 505B is not pushed up by the protruding portion 506, the first portion 505A extends substantially perpendicular to the lower frame 512. A projection 505D, which projects toward the blade 504, is formed on a side of the first portion 505A that faces the blade 504.

Figure 12C:
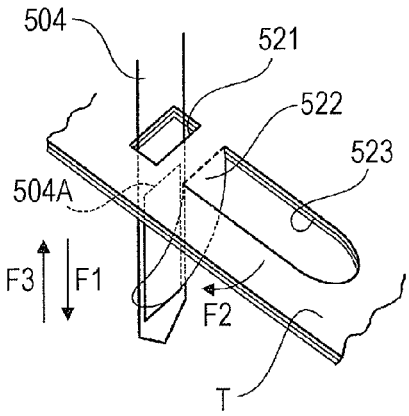

After the blade portion 505C of the first portion 505A has created the flap 522 in the sheet stack T, when the second portion 505B of the punching member 505 is further pushed up, the first portion 505A becomes further inclined and swings toward the blade 504. Therefore, as illustrated in FIG. 12C, the first portion 505A bends the flap 522 toward the slit opening 521. Thus, the projection 505D of the first portion 505A inserts the flap 522 into an eyelet 504A, which is an opening formed in the blade 504 that has created the slit opening 521. That is, the first portion 505A bends the flap 522, which has been cut by the first portion 505A, toward the slit opening 521, and inserts a free end of the flap 522 into the eyelet 504A in the blade 504 that extends through the slit opening 521.

Figure 12D:
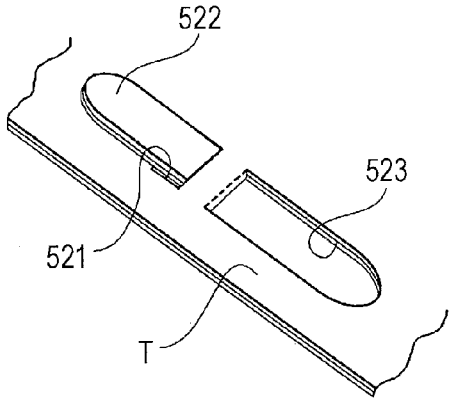

Thus, as illustrated in FIG. 12D, by extracting the blade 504 from the slit opening 521, the flap 522 is inserted into the slit opening 521.

The first binding unit 510 and the second binding unit 520 each include the sheet stack restriction member 540 (see also FIG. 2) between the base 501 of the upper frame 511 and the bottom member 502 of the lower frame 512. The sheet stack restriction member 540 restricts entry of the sheet stack T into the opening 507 and the opening 508 formed in the base 501. The sheet stack restriction member 540 prevents the sheet stack T from catching in the opening 507 and the opening 508 in the base 501 when the first binding unit 510 and the second binding unit 520 move in the directions A perpendicular to the transport path D of the sheet stack T (see FIG. 4B) to the binding positions of the sheet stack T that is supported by both of the sheet stacker 35 and the rotary plate 513. Thus, the first binding unit 510 and the second binding unit 520 are smoothly moved, and damage to the sheet stack T, displacement of the binding position, and loosened binding are prevented.

Next, the operation of the binding section 511C will be described in detail.

When the first binding unit 510 and the second binding unit 520 start the binding process, in the binding section 511C, a motor (not shown) drives a cam, and the cam moves the movable member 503 toward the base 501. The blade 504, which is disposed on a side the movable member 503 facing the base 501 (the lower frame 512), contacts the sheet stack T, and the blade 504 is pressed against the sheet stack T, whereby the leading edge 504B of the blade 504 penetrates the sheet stack T. Thus, the binding section 511C forms the slit opening 521, which is a slit-shaped opening, in the sheet stack T, as illustrated in FIG. 12B.

Moreover, when the movable member 503 moves toward the base 501, the protruding portion 506 of the base 501 pushes up the second portion 505B of the punching member 505. Accordingly, the first portion 505A of the punching member 505 becomes inclined and swings toward the blade 504 around the rotation shaft 505R. Thus, the blade portion 505C of the first portion 505A presses the sheet stack T, and the blade portion 505C penetrates the sheet stack T. Thus, as illustrated in FIG. 12B, the binding section 511C forms the flap 522, whose end portion 522A on the blade 504 side is connected to the sheet stack T, in the sheet stack T.

When the movable member 503 moves further toward the base 501, the first portion 505A of the punching member 505 becomes further inclined toward the blade 504. Thus, as illustrated in FIG. 12C, the projection 505D of the punching member 505 pushes the flap 522 toward the blade 504, and inserts the flap 522 into the eyelet 504A in the blade 504 (as indicated by an arrow F2 in FIG. 12C). The punching member 505 is not illustrated in FIG. 12C.

Subsequently, the movable member 503 is moved up and away from the lower frame 512, i.e., in a direction of an arrow F3 in FIG. 12A. Then, the flap 522, which has been inserted in the eyelet 504A in the blade 504, is raised. Thus, as illustrated in FIG. 12D, the flap 522 is inserted into the slit opening 521. Thus, the flap 522, which has been inserted into the slit opening 521, is wrapped around the sheet stack T. As a result, the sheet stack T is bound by the flap 522.

After the binding process has been finished, a binding hole 523 is formed in a part of the sheet stack T in which the flap 522 had been formed (see FIG. 12D). The binding hole 523 may be used as an opening for inserting binding rings of a file, a binder, and the like.

The sheet stack restriction member 540, which is an example of a guiding member, disposed in each of the first binding unit 510 and the second binding unit 520 will be described.

Figure 13A:
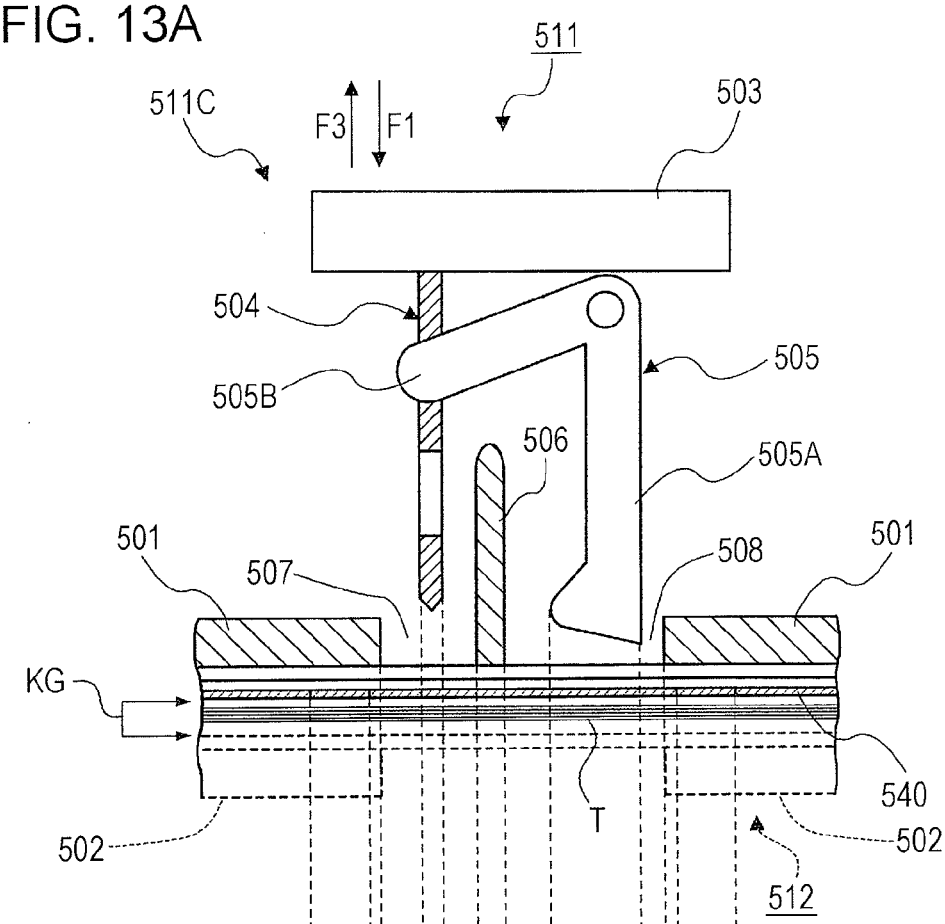
FIGS. 13A and 13B illustrate the configuration of a sheet stack restriction member.
Figure 13B:
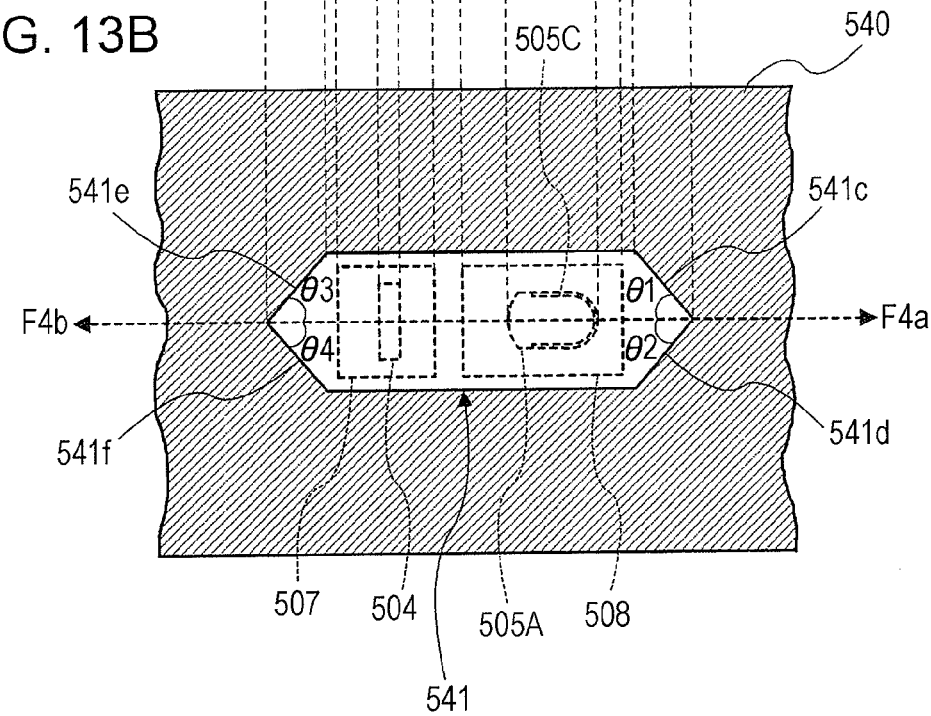

FIGS. 13A and 13B illustrate the configuration of the sheet stack restriction member 540. FIG. 13A is a sectional view of an area in which the binding section 511C operates, and FIG. 13B is a plan view of the sheet stack restriction member 540.

As illustrated in FIG. 13A, the sheet stack restriction member 540 is disposed on the bottom member 502 (the lower frame 512) side of the base 501 of the upper frame 511 and in an area in which the binding section 511C operates. The sheet stack restriction member 540 is disposed so that the gap KG (see FIG. 2) between the upper frame 511 and the lower frame 512 is positioned between the sheet stack restriction member 540 and the lower frame 512. That is, when the first binding unit 510 and the second binding unit 520 have moved closer to each other to perform the binding process on the sheet stack T, the sheet stack restriction member 540 is positioned between the base 501 and the sheet stack T, and the sheet stack T is positioned between the lower frame 512 and the sheet stack restriction member 540.

As illustrated in FIG. 13B, an opening 541 is formed in the sheet stack restriction member 540. The opening 541, which is an example of an opening, has a shape pointed (tapered) in directions in which the first binding unit 510 and the second binding unit 520 reciprocate (directions F4*a* and F4*b* (direction F4*a*=direction A in FIG. 4B)). That is, four edges of the opening 541 in directions in which the first binding unit 510 and the second binding unit 520 reciprocate (directions F4*a* and F4*b*) are inclined toward directions F4*a* and F4*b* and intersect the directions F4*a* and F4*b* at acute angles θ1, θ2, θ3, and θ4.

The opening 541 is formed so as to surround the opening 507 and the opening 508 formed in the base 501. Thus, when the binding process is performed, the blade 504 and the first portion 505A of the punching member 505 extend through the opening 541 and contact the sheet stack T.

As described above, for example, when performing the binding process at two positions in the middle portion of the sheet stack T (the middle portion in the directions A perpendicular to the transport direction D of the sheet stack T), the first binding unit 510 and the second binding unit 520 are moved in the directions A perpendicular to the transport direction D of the sheet stack T (=directions F4*a* and F4*b* in FIG. 13B). In this case, with an existing configuration that does not include the sheet stack restriction member 540, when the first binding unit 510 and the second binding unit 520 move toward binding positions of the sheet stack T that is supported by both of the sheet stacker 35 and the rotary plate 513, the sheet stack T may enter the opening 507 and the opening 508 formed in the bases 501 of the upper frames 511 of the first binding unit 510 and the second binding unit 520. In such a case, the first binding unit 510 and the second binding unit 520 do not move smoothly, so that the binding positions may be displaced or the sheet stack T may be damaged. Moreover, when the first binding unit 510 and the second binding unit 520 move in directions in which the first binding unit 510 and the second binding unit 520 are retracted from the sheet stack T on which the binding process has been performed, the flap 522 (see FIG. 12D) formed in the sheet stack T may catch on end edges of the opening 507 and the opening 508 in the base 501, whereby the sheet stack T may be damaged or binding of the sheet stack T may become loosened.

Figure 14A:
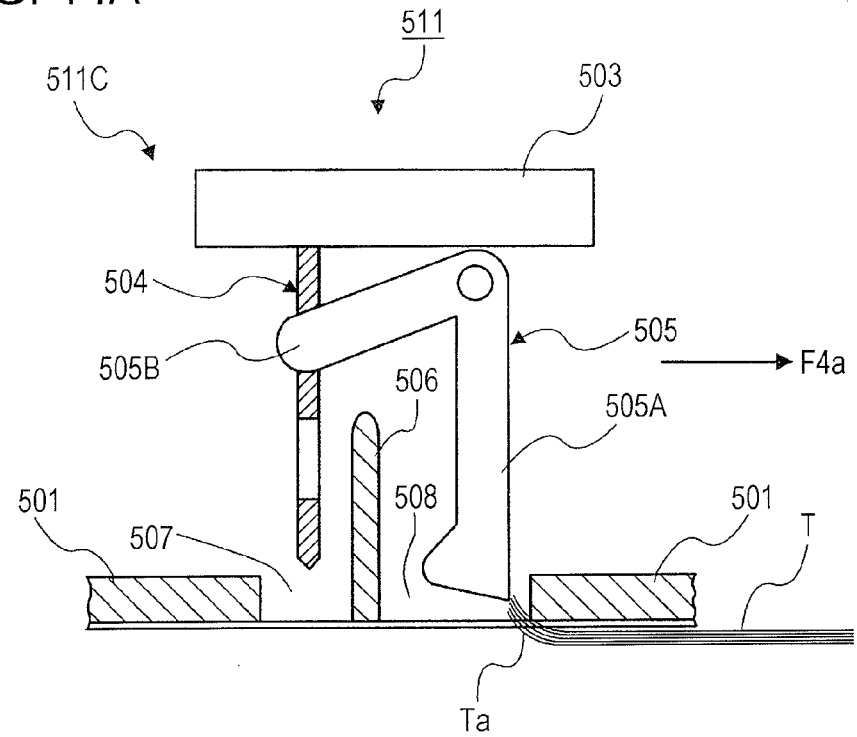
FIGS. 14A and 14B illustrate troubles that occur in an existing configuration in which the sheet stack restriction member according to the present exemplary embodiment is not provided.
Figure 14B:
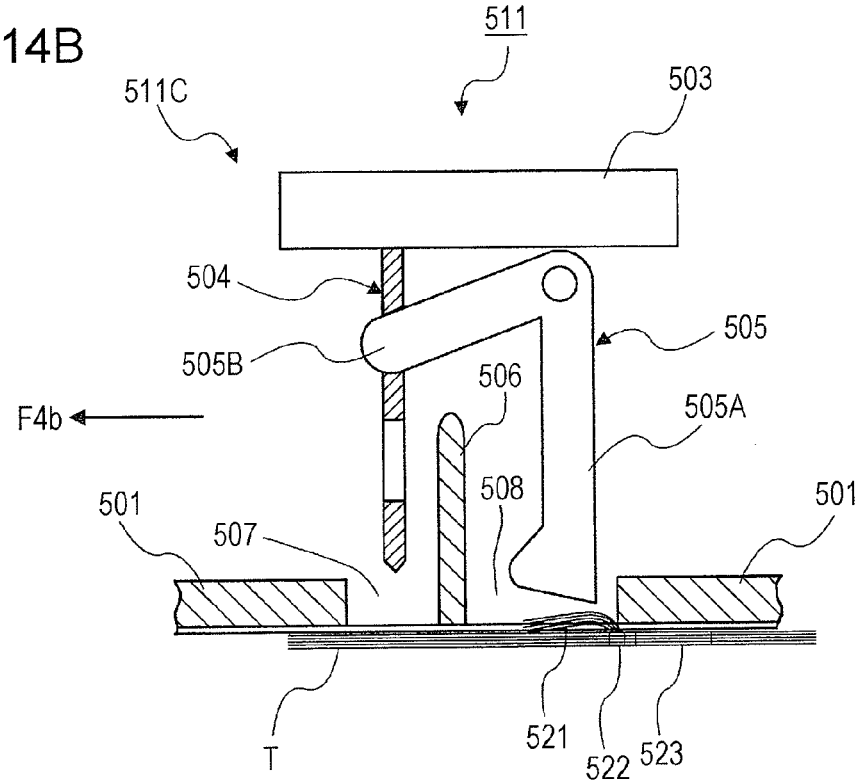

FIGS. 14A and 14B illustrate troubles that occur with an existing configuration in which the sheet stack restriction member 540 according to the present exemplary embodiment is not provided. FIG. 14A illustrates a case where the first binding unit 510 and the second binding unit 520 are moved to the binding positions of the sheet stack T. FIG. 14B illustrates a case where the first binding unit 510 and the second binding unit 520 are retracted from the sheet stack T on which the binding process has been performed.

As illustrated in FIG. 14A, if, for example, a deformation such as a warp, a corrugation, or a bulge is present in an end edge Ta of the sheet stack T, when the first binding unit 510 and the second binding unit 520 are moved toward the binding positions of the sheet stack T (in the direction F4*a*), the end edge Ta of the sheet stack T may catch on, for example, the first portion 505A of the punching member 505, which is positioned in the opening 508. Likewise, the end edge Ta of the sheet stack T may catch on the protruding portion 506 or a part of the base 501 at the boundary between the base 501 and the opening 507 (an end edge of the opening 507).

Moreover, as illustrated in FIG. 14B, when the first binding unit 510 and the second binding unit 520 are retracted from the sheet stack T (in the direction F4*b*), the flap 522 (see FIG. 12D) formed in the sheet stack T may catch on, for example, a part of the base 501 at the boundary between the base 501 and the opening 508 (an end edge of the opening 508).

Thus, with the existing configuration that does not include the sheet stack restriction member 540, damage to the sheet stack T, displacement of a binding position, and loosening of the bound sheet stack T may occur. In particular, in the first binding unit 510 and the second binding unit 520, which perform the binding process by deforming the sheet stack T in the thickness direction, the punching member 505 and the like move in a complex way as described above, so that the punching member 505 and the like need to be disposed near the sheet stack T. Thus, the sheet stack T may readily catch on the punching member 505 and other members of the binding section 511C, whereby damage to the sheet stack T, displacement of the binding position, and loosening of the bound sheet stack T may readily occur.

Therefore, in the present exemplary embodiment, the first binding unit 510 and the second binding unit 520 each include the sheet stack restriction member 540 for restricting entry of the sheet stack T into the opening 507 and the opening 508 formed in the base 501. By providing the sheet stack restriction member 540, when the first binding unit 510 and the second binding unit 520 are moved to binding positions of the sheet stack T that is supported by both of the sheet stacker 35 and the rotary plate 513, the sheet stack T is prevented from catching in the opening 507 and the opening 508 in the base 501. When retracting the first binding unit 510 and the second binding unit 520 from the sheet stack T, the flap 522 is prevented from catching in, for example, the opening 508. Thus, the first binding unit 510 and the second binding unit 520 are smoothly moved. Moreover, the sheet stack T is prevented from catching on the punching member 505 or other members of the binding section 511C, whereby damage to the sheet stack T, displacement of the binding positions, and loosening of the bound sheet stack T are prevented.

Description of Effect of Sheet Stack Restriction Member on Sheet Stack

Next, the effect of the sheet stack restriction member 540, which is disposed in each of the first binding unit 510 and the second binding unit 520 according to the present exemplary embodiment, on the sheet stack T will be described.

As described above, the sheet stack restriction member 540 is disposed between the base 501 and the sheet stack T and in an area in which the binding section 511C moves in directions normal to the base 501 (directions F1 and F3) (see FIG. 13A). The opening 541 is formed in the sheet stack restriction member 540 so as to surround the opening 507 and the opening 508 formed in the base 501. The opening has a shape that is pointed (tapered) in directions (directions F4*a* and F4*b*) in which the first binding unit 510 and the second binding unit 520 reciprocate. That is, the first binding unit 510 and the second binding unit 520 reciprocate in directions F4*a* and F4*b*, and edges 541*c* and 541*d* of the opening 541 in the direction F4*a* and edges 541*e* and 541*f* of the opening 541 in the direction F4*b* are respectively inclined in directions F4*a* and F4*b*, and intersect the directions F4*a* and F4*b* at acute angles θ1, θ2, θ3, and θ4 (see FIG. 13B).

As long as the angles θ1, θ2, θ3, and θ4 are acute angles, some or all of these angles may be the same, or all of these angles may be different from one another. In the present exemplary embodiment, the edges 541*c*, 541*d*, 541*e*, and 541*f* of the opening 541 are straight lines. However, these edges may be curved, as long as the edges are inclined in the directions F4*a* and F4*b* and intersect the directions F4*a* and F4*b*.

Thus, the opening 541 formed in the sheet stack restriction member 540 allows the blade 504 and the first portion 505A of the punching member 505, which perform the binding process, to extend therethrough. Moreover, when the first binding unit 510 and the second binding unit 520 reciprocate, the opening 541 prevents the sheet stack T from catching in the opening 507 and the opening 508 formed in the base 501 of the upper frame 511.

Figure 15A:
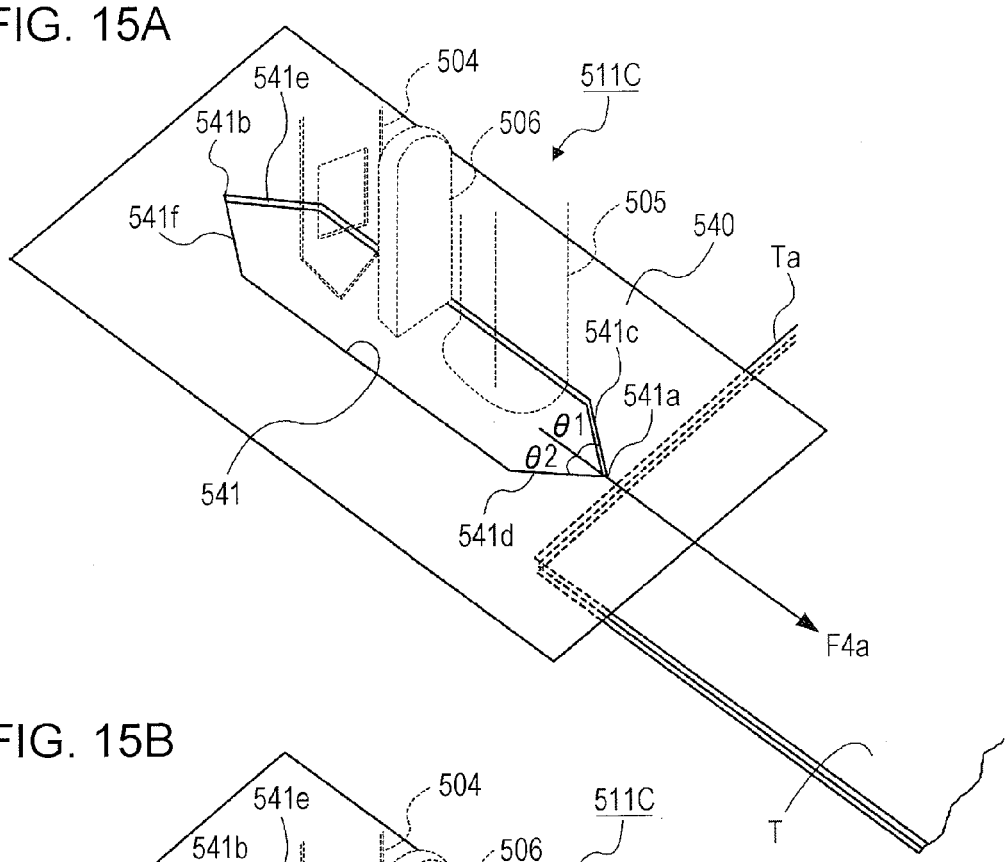
FIGS. 15A and 15B illustrate the sheet stack restriction member.
Figure 15B:
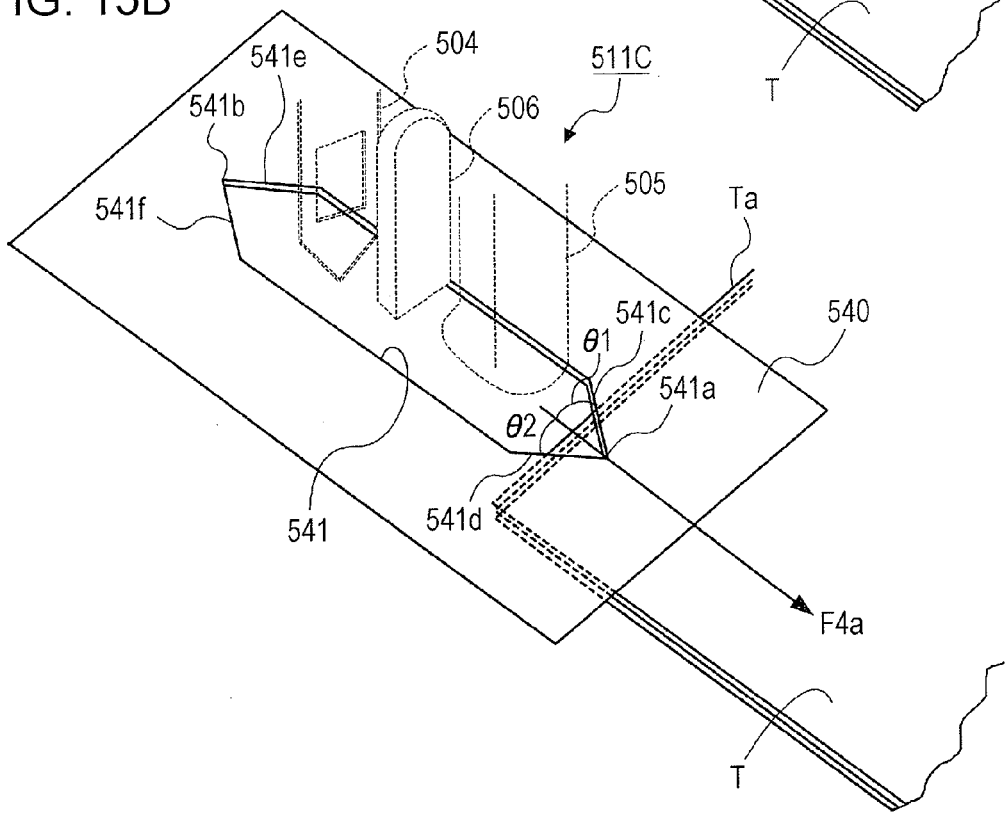

For example, FIGS. 15A and 15B illustrate the effect that the sheet stack restriction member 540 exerts on the sheet stack T when the first binding unit 510 (see FIG. 3) moves toward a binding position of the sheet stack T (in the direction F4*a*) that is supported by the sheet stacker 35 and the rotary plate 513. FIG. 15A illustrates a state immediately before an end 541*a* of the opening 541 in the sheet stack restriction member 540 near the sheet stack T enters a stacked area of the sheet stack T. FIG. 15B illustrates a state immediately after the opening 541 in the sheet stack restriction member 540 has entered the stacked area of the sheet stack T.

As illustrated in FIG. 15A, the end 541*a* of the opening 541 of the sheet stack restriction member 540 near the sheet stack T has a shape that is pointed (tapered) toward the sheet stack T (=in the direction F4*a*). That is, the edges 541*c* and 541*d* of the opening 541 near the sheet stack T (in the direction F4*a*) respectively intersect the direction F4*a* at acute angles θ1 and θ2. Therefore, when the opening 541 enters the stacked area of the sheet stack T, the end 541*a* of the opening 541 enters first, and then the remaining part of the opening 541 gradually enter the end edge Ta of the sheet stack T. That is, regarding the opening 541 in the sheet stack restriction member 540, the end 541*a*, which contacts the end edge Ta of the sheet stack T with a very small area, first contacts the end edge Ta. Therefore, the end edge Ta of the sheet stack T does not readily enter the opening 541.

After the end 541*a* of the opening 541 has passed the end edge Ta of the sheet stack T, as illustrated in FIG. 15B, the sheet stack restriction member 540 around the opening 541 serves to press the sheet stack T, and the edges 541*c* and 541*d* of the opening 541, which gradually spread out, enter the sheet stack T.

Thus, for example, even if a deformation, such as a warp, a corrugation, or a bulge is present in the end edge Ta of sheet stack T, the sheet stack restriction member 540 enters the sheet stack T without causing the sheet stack T to catch on the end edge Ta. At this time, a part of the sheet stack restriction member 540 around the opening 541 presses the sheet stack T. Thus, the end edge Ta of the sheet stack T is prevented from entering the opening 508; from catching on, for example, the first portion 505A of the punching member 505 positioned in the opening 508; and from catching on the protruding portion 506 or a part the base 501 (an end edge of the opening 507) on the boundary between the base 501 and the opening 507.

Figure 16A:
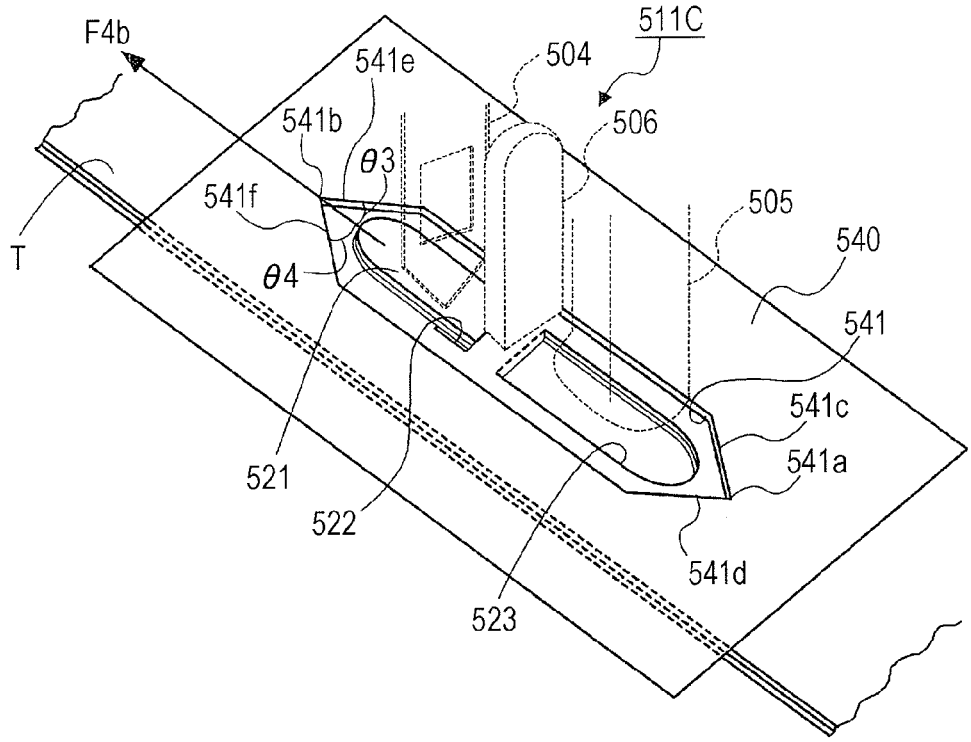
FIGS. 16A and 16B illustrate the sheet stack restriction member.
Figure 16B:
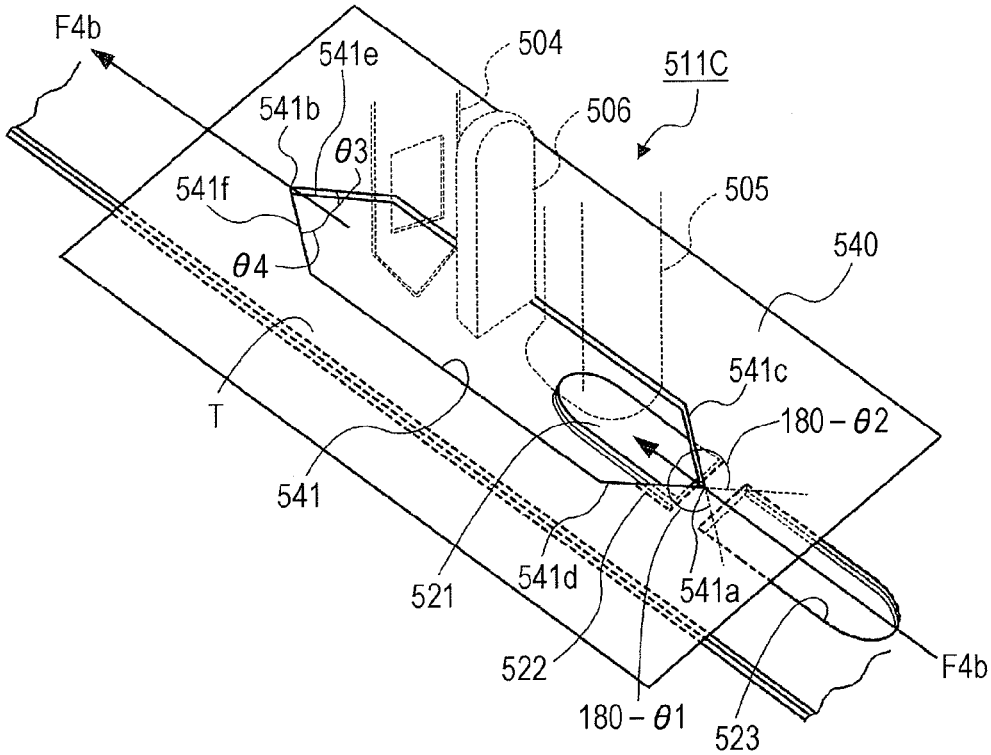

FIGS. 16A and 16B illustrate the effect that the sheet stack restriction member 540 exerts on the sheet stack T when, for example, the first binding unit 510 (see FIG. 3) moves in a direction in which the first binding unit 510 is retracted from the sheet stack T (in the direction F4*b*). FIG. 16A illustrates a state immediately after the binding section 511C of the first binding unit 510 has performed the binding process on the sheet stack T. FIG. 16B illustrates a state in which the opening 541 in the sheet stack restriction member 540 is passing over the flap 522 (see FIG. 12D) formed in the sheet stack T.

As illustrated in FIG. 16A, when the binding section 511C of the first binding unit 510 performs the biding process on the sheet stack T, the flap 522 is formed by the blade 504 and the punching member 505 in the opening 541 of the sheet stack restriction member 540. In this state, when the first binding unit 510 moves in a direction in which the first binding unit 510 is retracted from the sheet stack T (in the direction F4*b*) as illustrated in FIG. 16B, the edges 541*c* and 541*d* on the end 541*a* side of the opening 541, which is opposite to the side toward which the opening 541 moves, move while contacting the flap 522 at obtuse angles 180-θ1 and 180-θ2. At this time, a part of the sheet stack restriction member 540 around the opening 541 presses the flap 522. Thus, the end portion of the opening 541 opposite to the end in which the opening 541 moves (edges 541*c* and 541*d*, and the end 541*a*) smoothly passes over the flap 522. Thus, the flap 522 is prevented from entering the opening 508, and the flap 522 is prevented from catching on, for example, a part of the base 501 on the boundary between the base 501 and the opening 508 (the end edge of the opening 508).

In this case, the binding section 511C of the first binding unit 510 forms the flap 522 so that a free end of the flap 522 (an end portion of the flap 522 inserted into the slit opening 521) is oriented towards the direction in which the first binding unit 510 is retracted (direction F4*b*). To be specific, the slit opening 521 is formed between the flap 522 and the end edge Ta of the sheet stack T, so that the free end of the flap 522 is oriented toward the end edge Ta of the sheet stack T when the flap 522 is inserted into the slit opening 521. Thus, a part of the flap 522 near the end 541*a*, which is opposite to the end in which the opening 541 moves, does not have an edge. Thus, the flap 522 is more reliably prevented from entering the opening 541. The same applies to the binding section 511C of the second binding unit 520.

Thus, each of the first binding unit 510 and the second binding unit 520 according to the present exemplary embodiment includes the sheet stack restriction member 540 for restricting entry of the sheet stack into the opening 507 and the opening 508 formed in the base 501. Thus, the first binding unit 510 and the second binding unit 520 smoothly moves when performing the binding process, so that damages to the sheet stack T, displacement of the binding position, and loosening of the sheet stack T are prevented.

As illustrated in FIGS. 15A to 16B, regarding the opening 541 formed in the sheet stack restriction member 540 of the first binding unit 510, not only the end 541*a* in a direction in which the opening 541 enters the stacked area of the sheet stack T (direction F4*a*) but also an end 541*b* in a direction opposite to the direction in which the sheet stack restriction member 540 enters the stacked area of the sheet stack T (direction F4*b*) has a pointed (tapered) shape as with the end 541*a*. That is, the edges 541*e* and 541*f*, which are at an end of the opening 541 in which the sheet stack restriction member 540 retracts from the sheet stack T, intersect the direction F4*b* at acute angles θ3 and θ4. This is in order to smoothly pass over a deformed portion, such as a projection, a warp, a corrugation, or a bulge, which may have been formed on the sheet stack T, when, for example, the first binding unit 510 moves in the direction F4*b* in which the first binding unit 510 is retracted from the sheet stack T as illustrated in FIGS. 16A and 16B. This is also in order to smoothly pass over the flap 522 even if another flap 522 that has been used for binding is present in the F4*b* direction in which the first binding unit 510 is retracted. However, depending on the arrangement of the binding positions at which the first binding unit 510 and the second binding unit 520 perform the binding processes (for example, performing the binding processes first in a middle portion and then in the peripheral portion of the sheet stack T) and depending on the state of the sheet stack T, it is not necessary to form the end 541*b* on the opposite side so as to have a pointed (tapered) shape. Therefore, only the end 541*a*, which is an end in the direction in which the sheet stack restriction member 540 enters the stacked area of the sheet stack T (direction F4*a*), may have a pointed (tapered) shape.

The above-described binding section 511C, which is included in each of the first binding unit 510 and the second binding unit 520, is configured to perform the binding process by inserting the flap 522 into the slit opening 521. As another configuration, a binding mechanism included in each of the first binding unit 510 and the second binding unit 520, which deforms the sheet stack T in the thickness direction, may use a method of crimping the sheets S of the sheet stack T together. The sheet stack restriction member is also used in the first binding unit 510 and the second binding unit 520 including the binding section 511C that uses the method of crimping the sheets S together.

Figure 17A:
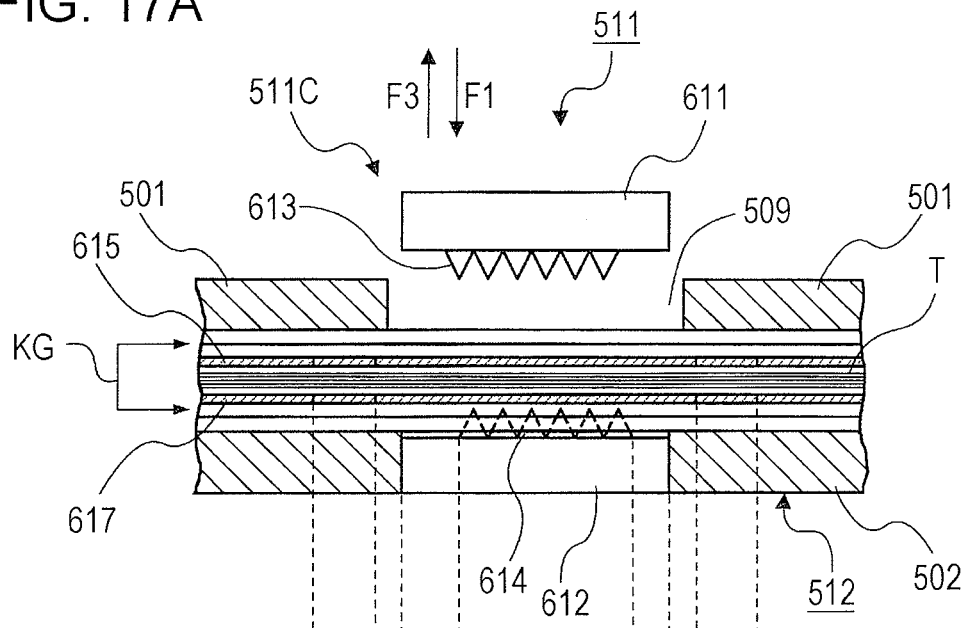
FIGS. 17A and 17B illustrate a binding unit each including a binding section, which uses a method of crimping sheets of the sheet stack together.
Figure 17B:
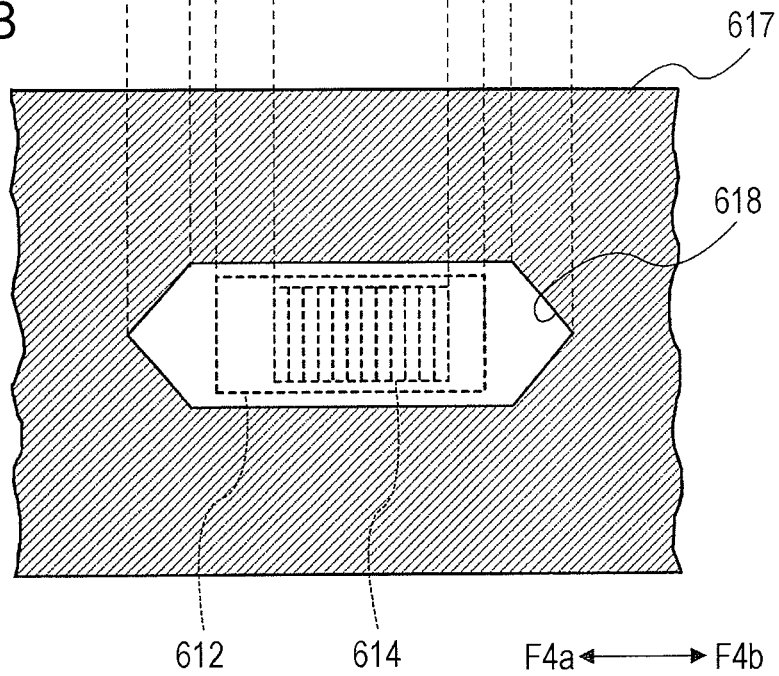

FIGS. 17A and 17B illustrate the first binding unit 510 and the second binding unit 520 that includes the binding section 511C that uses the method of crimping the sheets S of the sheet stack T together. The first binding unit 510 includes sheet stack restriction members 615 and 617 that are disposed so as to sandwich the sheet stack T in the vertical direction. FIG. 17A is a sectional view of an area in which the binding section 511C operates, and FIG. 17B is a plan view of the sheet stack restriction member 617 disposed on the lower frame 512 side.

The binding section 511C, which uses the method of crimping the sheet S together, is disposed in the upper frame 511 of each of the first binding unit 510 and the second binding unit 520. The binding section 511C includes an upper crimping frame 611 that reciprocates in directions normal to the base 501 of the upper frame 511 (directions F1 and F3). Upper surface crimping teeth 613 are disposed on the lower frame 512 side of the upper crimping frame 611. An opening 509, through which the upper crimping frame 611 passes, is formed in the base 501. In the bottom member 502 of the lower frame 512, a lower crimping frame 612 is disposed so as to face the upper crimping frame 611. Lower surface crimping teeth 614 are disposed in an area on the upper surface of the lower crimping frame 612 that faces the upper surface crimping teeth 613. The lower surface crimping teeth 614 presses the lower surface of the sheet stack T so as to mesh with the upper surface crimping teeth 613. The lower crimping frame 612 may be fixed to the bottom member 502, or may be configured to reciprocate in accordance with the movement of the upper crimping frame 611.

With such a structure, when the upper crimping frame 611 and the lower crimping frame 612 crimp the sheet stack T in the opening 509, the upper surface crimping teeth 613 and the lower surface crimping teeth 614 mesh with each other, whereby the sheet stack T including plural sheets S is bound.

The sheet stack restriction member 615 is disposed between the base 501 of the upper frame 511 and the sheet stack T. The sheet stack restriction member 617 is disposed between the bottom member 502 of the lower frame 512 and the sheet stack T. The sheet stack restriction member 617 on the lower frame 512 side is configured to retract toward the lower crimping frame 612 in accordance with the movement of the upper crimping frame 611 toward the lower crimping frame 612. Openings 616 and 618 are formed in the sheet stack restriction members 615 and 617, as with the opening 541 in the sheet stack restriction member 540 illustrated in FIG. 13B. By thus disposing the sheet stack restriction member 615, in which the opening 616 (see FIG. 18A) is formed, on the upper crimping frame 611 side with respect to the sheet stack T, the sheet stack T is prevented from catching on the upper surface crimping teeth 613 of the upper crimping frame 611. Moreover, by disposing the sheet stack restriction member 617, in which the opening 618 is formed, on the lower crimping frame 612 side with respect to the sheet stack T, the sheet stack T is prevented from catching on the lower surface crimping teeth 614 of the lower crimping frame 612. FIG. 17B illustrates sheet stack restriction member 617, which is disposed on the lower frame 512 side.

Figure 18A:
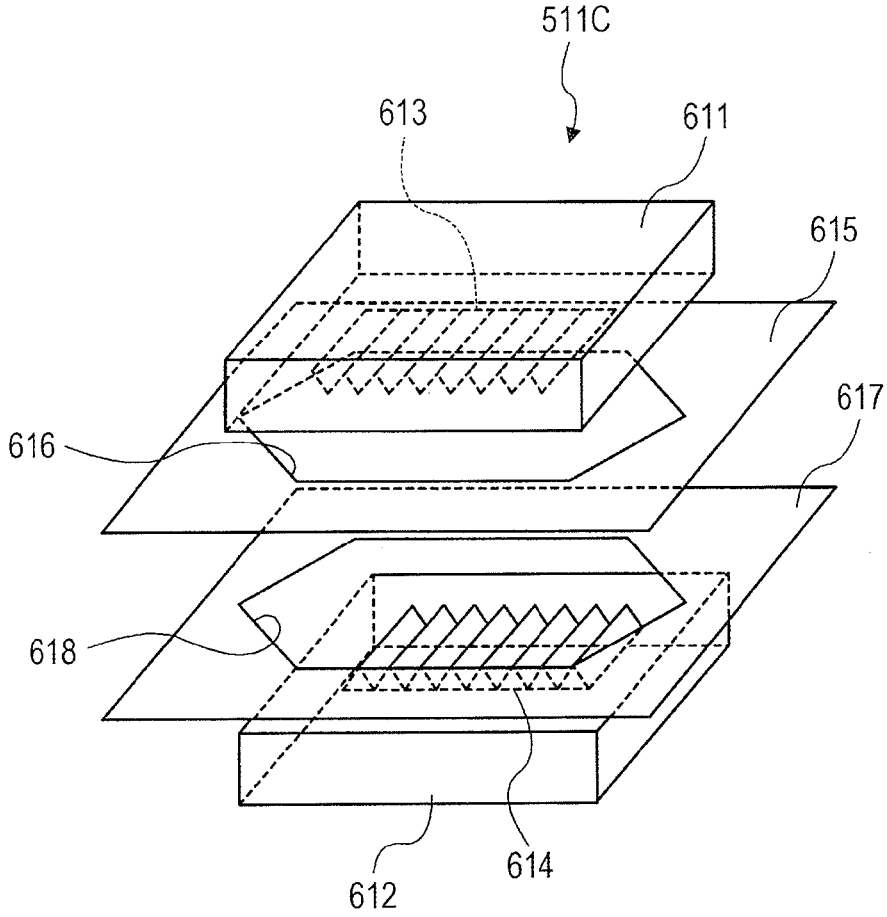
FIGS. 18A and 18B further illustrate the binding unit that binds sheets by crimping the sheets together.
Figure 18B:
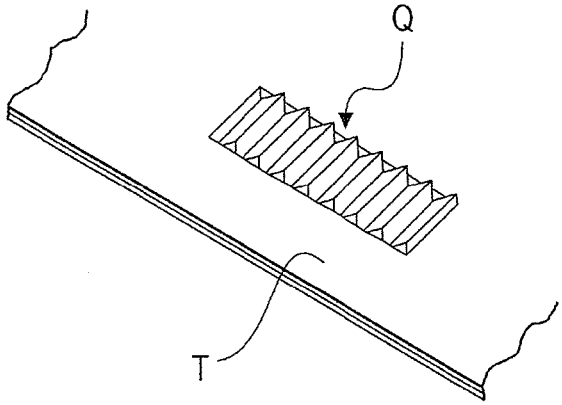

FIGS. 18A and 18B further illustrate the binding section 511C that binds sheets S by crimping the sheets S together. FIG. 18A is a perspective view of the upper crimping frame 611 and the lower crimping frame 612, which are disposed in the binding section 511C and crimp the sheets S together. FIG. 18B illustrates the sheet T after the binding process of crimping the sheets S together has been finished. In FIG. 18A, the components of the upper frame 511 and the lower frame 512 are not illustrated.

As illustrated in FIG. 18A, the upper surface crimping teeth 613 are formed on the lower surface of the upper crimping frame 611. The upper surface crimping teeth 613, which crimp the upper surface of the sheet stack T, have ridges and furrows. The lower surface crimping teeth 614 are formed in an area on the upper surface of the lower crimping frame 612 that faces the upper surface crimping teeth 613. The lower surface crimping teeth 614, which crimp the lower surface of the sheet stack T, have ridges and furrows.

With such a structure, when the upper crimping frame 611 and the lower crimping frame 612 crimps the sheet stack T, the upper surface crimping teeth 613 and the lower surface crimping teeth 614 mesh with each other. Thus, as illustrated in FIG. 18B, a deformed portion Q, which is an example of a deformed portion and have ridges and furrows in the thickness direction, is formed on the sheet stack T. In the deformed portion Q of the sheet stack T having ridges and furrows in the thickness direction, fibers that constitute adjacent sheets S intertwine with one another. Thus, the sheet stack T including plural sheets S is bound.

In the first binding unit 510 and the second binding unit 520 each including the binding section 511C, the sheet stack restriction member 615, in which the opening 616 is formed, is disposed between the base 501 of the upper frame 511 and the sheet stack T. Moreover, the sheet stack restriction member 617, in which the opening 618 is formed, is disposed between the bottom member 502 of the lower frame 512 and the sheet stack T. Thus, when the first binding unit 510 and the second binding unit 520 are moved to the binding positions of the sheet stack T, which is supported by the sheet stacker 35 and the rotary plate 513, in directions A (see FIG. 4B) perpendicular to the transport path D of the sheet stack T, the sheet stack T is prevented from catching on the upper surface crimping teeth 613 of the upper crimping frame 611 and the lower surface crimping teeth 614 of the lower crimping frame 612.

As heretofore described, in the sheet processing apparatus 3 according to the present exemplary embodiment, the binding device 500, which performs the binding process by deforming the sheet stack T in the thickness direction, includes a sheet stack restriction member for restricting entry of the sheet stack T into an opening over which a mechanism for performing the binding process passes when the mechanism reciprocates toward the sheet stack T. Thus, the sheet stack T is prevented from catching in the opening, so that damage to the sheet stack T, displacement of the binding position, and loosening of the sheet stack T are prevented.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A recording medium post-processing apparatus comprising:

a recording medium stacking member onto which a plurality of recording media are stacked to form a stacked area;

a first binding member that moves to an inside of the stacked area after the recording media are stacked on the recording medium stacking member, binds the recording media by deforming the recording media after moving to the inside of the stacked area, and moves to an outside of the stacked area after binding the recording media;

a guiding member disposed between the first binding member and the recording media and fixed to the first binding member, the guiding member guiding the recording media so that a gap between the recording media and the first binding member is maintained when the first binding member moves around the inside of the stacked area; and a controller which automatically controls the first binding member to move inside of the stacked area to bind the recording media and bind the recording media that is stacked, wherein the guiding member has an opening that surrounds an area in which the first binding member operates to deform the recording media, and a part of the opening is narrowed in a moving direction of the first binding member.

2. The recording medium post-processing apparatus according to claim 1, wherein the narrowed part of the opening in the guiding member has a V-shaped portion.

3. The recording medium post-processing apparatus according to claim 1, wherein the binding member binds the recording media by forming a slit and a tongue-shaped portion in the recording media, by inserting a free end of the tongue-shaped portion into the slit, and by wrapping the tongue-shaped portion around the recording media, and wherein the slit is formed at a position nearer to an end of the recording media than the tongue-shaped portion so that the free end of the tongue-shaped portion is inserted into the slit towards the end of the recording media.

4. The recording medium post-processing apparatus according to claim 3, wherein a recording medium output tray is arranged below the recording medium stacking member so that the recording media bound by the binding member are outputted downward.

5. The recording medium post-processing apparatus according to claim 1, further comprising:

a second binding member that binds an end portion of the recording media, wherein the first binding member binds another end portion that is opposite to the end portion in a transporting direction in which the recording media is transported to the recording medium stacker.

6. The recording medium post-processing apparatus according to claim 1, further comprising a moving mechanism that moves the first binding member.

7. An image forming system comprising:

an image forming apparatus that forms images on recording media; and a recording medium post-processing apparatus into which the recording media on which the images have been formed by the image forming apparatus are sequentially transported, the recording medium post-processing apparatus performing a binding process on the recording media, the recording medium post-processing apparatus including a recording medium stacking member onto which a plurality of recording media are stacked to form a stacked area, the recording media being transported from the image forming apparatus, a binding member that moves to an inside of the stacked area after the recording media are stacked on the recording medium stacking member, binds the recording media by deforming the recording media after moving to the inside of the stacked area, and moves to an outside of the stacked area after binding the recording media, a guiding member disposed between the binding member and the recording media and fixed to the binding member, the guiding member guiding the recording media so that a gap between the recording media and the binding member is maintained when the binding member moves around the inside of the stacked area, and a controller which automatically controls the first binding member to move inside of the stacked area to bind the recording media and bind the recording media that is stacked, wherein the guiding member has an opening that surrounds an area in which the binding member operates to deform the recording media, and a part of the opening is narrowed in the moving direction of the binding member.

8. The image forming system according to claim 7, wherein, in the recording medium post-processing apparatus, the part of the opening in the guiding member has a V-shaped portion.

9. The image forming system according to claim 8, wherein, in the recording medium post-processing apparatus, the binding member binds the recording media by forming a slit and a tongue-shaped portion in the recording media, and by inserting a free end of the tongue-shaped portion into the slit, and wherein the slit is formed at a position nearer to an end of the recording media than the tongue-shaped portion so that the free end of the tongue-shaped portion is inserted into the slit towards the end of the recording media.

* * * * *